US009573043B2

(12) United States Patent
Ritter

(10) Patent No.: US 9,573,043 B2
(45) Date of Patent: Feb. 21, 2017

(54) BOOT BINDING SYSTEM WITH FOOT LATCH PEDAL

(71) Applicant: William J Ritter, Bozeman, MT (US)

(72) Inventor: William J Ritter, Bozeman, MT (US)

( * ) Notice: Subject to any disclaimer, the term of this patent is extended or adjusted under 35 U.S.C. 154(b) by 0 days.

(21) Appl. No.: 14/815,432

(22) Filed: Jul. 31, 2015

(65) Prior Publication Data

US 2015/0335986 A1 Nov. 26, 2015

Related U.S. Application Data

(63) Continuation of application No. 14/142,433, filed on Dec. 27, 2013, now Pat. No. 9,126,099.

(Continued)

(51) Int. Cl.
*A63C 10/18* (2012.01)
*A63C 9/00* (2012.01)

(Continued)

(52) U.S. Cl.
CPC ..... *A63C 10/18* (2013.01); *A63C 5/02* (2013.01); *A63C 5/03* (2013.01); *A63C 9/00* (2013.01);

(Continued)

(58) Field of Classification Search
CPC ..... A63C 10/18; A63C 9/00; A63C 5/02; A63C 5/03

(Continued)

(56) References Cited

U.S. PATENT DOCUMENTS 3,061,325 A 10/1962 Glass
3,977,688 A * 8/1976 Imagawa ..... A63C 9/00 280/607

(Continued)

FOREIGN PATENT DOCUMENTS

DE 9108618 1/1992
EP 0362782 B1 8/1992

(Continued)

OTHER PUBLICATIONS

SHOEBOARD Commercial Product—1 page description purportedly circa 2005, mini-ski binding with apparent adjustable toepiece and pivotable heel piece. Pivot located inferior to metatarsals at ball of foot. (As attested by B Kunzler Esq).

(Continued)

*Primary Examiner* — J. Allen Shriver, II
*Assistant Examiner* — Brian Cassidy
(74) *Attorney, Agent, or Firm* — Lambert Patent Services; Kal K Lambert

(57) ABSTRACT

Boot binding systems for riding a snow gliding board, including a pair of boot bindings, each member of the pair having a toe latch pedal mechanism at the toe end of a baseplate on which the rider's boot rests, the toe latch pedal having dual function to either a) attach each boot binding to a ride mode interface in ride mode configuration or to b) attach each boot binding to a ski touring mode interface in ski touring configuration. In a "release position" the toe latch pedal is disengaged so that the baseplate assembly may be detached or switched between the ski touring mode interface and the ride mode interface in alternation. In a "lock position", the toe of the rider's boot depresses the toe latch pedal and locks the boot binding onto the selected interface. As co-planar with the baseplate, the latch pedal also supports the rider's boot when in the lock position.

21 Claims, 32 Drawing Sheets

Related U.S. Application Data

(60) Provisional application No. 61/778,329, filed on Mar. 12, 2013, provisional application No. 61/757,216, filed on Jan. 27, 2013.

(51) Int. Cl.

| | |
|---|---|
| ***A63C 10/20*** | (2012.01) |
| ***A63C 5/02*** | (2006.01) |
| ***A63C 5/03*** | (2006.01) |
| ***A63C 9/02*** | (2012.01) |
| ***A63C 10/14*** | (2012.01) |
| ***A63C 10/28*** | (2012.01) |

(52) U.S. Cl.
CPC ..... *A63C 9/002* (2013.01); *A63C 9/006* (2013.01); *A63C 9/02* (2013.01); *A63C 10/14* (2013.01); *A63C 10/20* (2013.01); *A63C 10/28* (2013.01); *A63C 2203/06* (2013.01)

(58) Field of Classification Search
USPC ..... 280/623, 818, 603, 14.26, 14.24, 14.21
See application file for complete search history.

(56) References Cited

U.S. PATENT DOCUMENTS

| | | | | |
|---|---|---|---|---|
| 5,035,443 | A | 7/1991 | Kincheloe | |
| 5,076,604 | A | 12/1991 | Wittmann | |
| 5,114,172 | A * | 5/1992 | Rousset | A63C 9/00 280/615 |
| 5,649,722 | A * | 7/1997 | Champlin | A63C 5/02 280/14.22 |
| 5,660,416 | A * | 8/1997 | Schiele | A63C 5/16 280/14.21 |
| 5,697,631 | A | 12/1997 | Ratzek | |
| 5,741,023 | A * | 4/1998 | Schiele | A63C 9/02 280/14.21 |
| 5,884,933 | A * | 3/1999 | Trott | A63C 5/03 280/14.22 |
| 5,984,324 | A * | 11/1999 | Wariakois | A63C 5/02 280/14.24 |
| 6,000,711 | A * | 12/1999 | Fey | A63C 5/02 280/14.21 |
| 6,315,305 | B1 * | 11/2001 | Gien | A63C 10/22 280/11.26 |
| 6,523,851 | B1 * | 2/2003 | Maravetz | A63C 5/02 280/14.22 |
| 7,823,905 | B2 * | 11/2010 | Ritter | A63C 5/02 280/14.26 |
| 8,033,564 | B2 * | 10/2011 | Riepler | A63C 5/02 280/603 |
| 8,226,109 | B2 * | 7/2012 | Ritter | A63C 5/02 280/14.26 |
| 8,348,299 | B2 * | 1/2013 | Ekberg | A63C 5/02 280/11.27 |
| 8,469,372 | B2 * | 6/2013 | Kloster | A63C 5/02 280/14.22 |
| 8,708,371 | B2 * | 4/2014 | Balun | A63C 5/033 280/14.21 |
| 8,733,783 | B2 * | 5/2014 | Kloster | A63C 5/02 280/14.22 |
| 8,764,043 | B2 * | 7/2014 | Neubauer | A63C 10/16 280/607 |
| 9,022,412 | B2 * | 5/2015 | Ritter | A63C 5/02 280/14.26 |
| 9,126,099 | B2 * | 9/2015 | Ritter | A63C 5/02 |
| 9,132,336 | B2 * | 9/2015 | Bulan | A63C 5/02 |
| 9,220,968 | B2 * | 12/2015 | Ritter | A63C 9/0846 |
| 2004/0070176 | A1 | 4/2004 | Miller | |
| 2007/0216137 | A1 * | 9/2007 | Ritter | A63C 5/02 280/623 |
| 2008/0185814 | A1 * | 8/2008 | Riepler | A63C 5/02 280/601 |
| 2009/0250906 | A1 * | 10/2009 | Ritter | A63C 5/02 280/623 |
| 2010/0102522 | A1 * | 4/2010 | Kloster | A63C 5/02 280/14.24 |
| 2012/0256395 | A1 * | 10/2012 | Ritter | A63C 5/02 280/623 |
| 2012/0274036 | A1 * | 11/2012 | Kloster | A63C 5/0411 280/11.31 |
| 2013/0229000 | A1 * | 9/2013 | Ekberg | A63C 9/00 280/614 |
| 2013/0277947 | A1 * | 10/2013 | Kloster | A63C 5/02 280/618 |
| 2014/0138935 | A1 * | 5/2014 | Sorenson | A63C 10/14 280/611 |
| 2014/0232087 | A1 * | 8/2014 | Bulan | A63C 5/02 280/620 |
| 2014/0291965 | A1 * | 10/2014 | Kloster | A63C 5/02 280/607 |
| 2015/0014962 | A1 * | 1/2015 | Rayner | A63C 10/145 280/611 |
| 2015/0343298 | A1 * | 12/2015 | Ritter | A63C 9/0846 280/11.31 |

FOREIGN PATENT DOCUMENTS

| | | | |
|---|---|---|---|
| EP | 0787512 | B1 | 1/1997 |
| EP | WO 98/17355 | A1 | 4/1998 |
| WO | WO 93/14835 | A1 | 8/1993 |
| WO | WO 2013/078477 | A1 | 4/2014 |

OTHER PUBLICATIONS

SHOEBOARD_BackPacking Light—1 page description dated 2006 from Back Packing Light On-Line product review.

Commercial Product Description-NITRO—Early splitboard distributed circa 1991-1993 by Nitro USA of Seattle WA; with Fritschi AT bindings and interface. Annotated photographs 1-10. Author: K Karel Lambert.

Voile Backcountry Ski and Snowboard Equipment 97-98. (Voile, Salt Lake City UT). (2 pages) paragraphs 4,5: "The slider tracks slide onto . . . ".

Nitro USA Snowboards Boardline 1993-1994 (Nitro USA, Seattle WA) (4 pages) p. 2 see photo, splitboard with ski-mode and snowboard-mode mounting assemblies, including slidably engageable conjoining bindings (see "Instruction or Use" attached below).

NitroUSA "Instructions for Use" (undated) p. 3 Riding position (Illustration [d]) ". . . slide the binding forward . . . " Full text and illustrations.

* cited by examiner

100

200

Fig 16
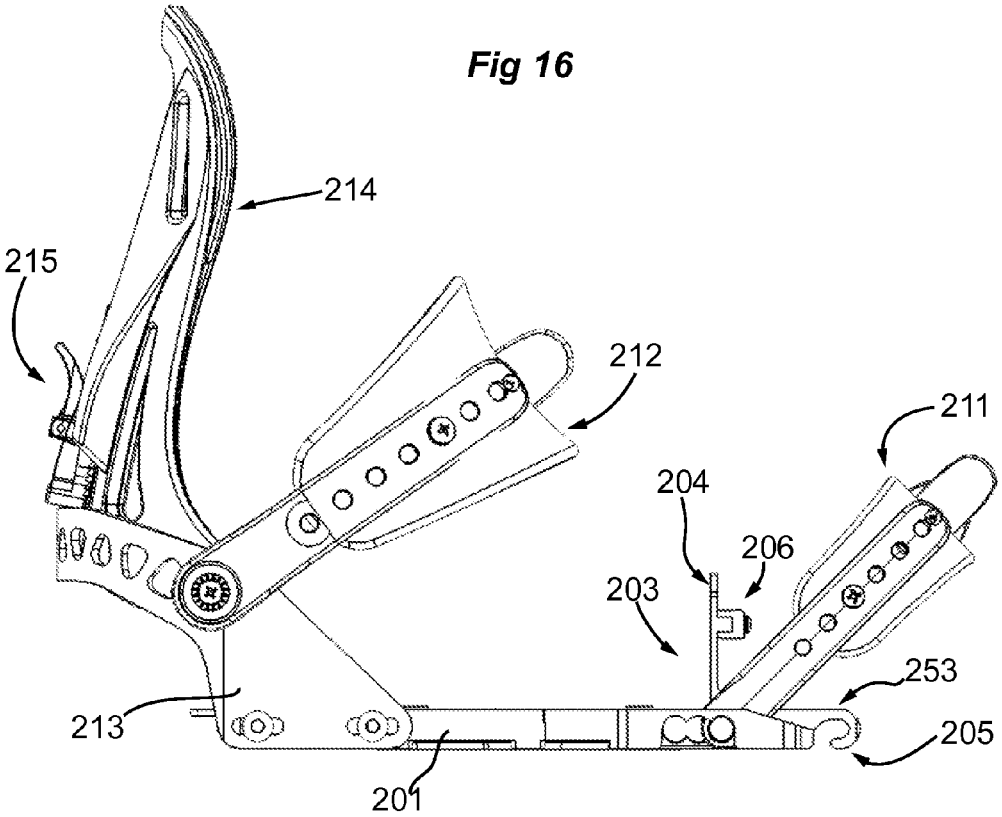
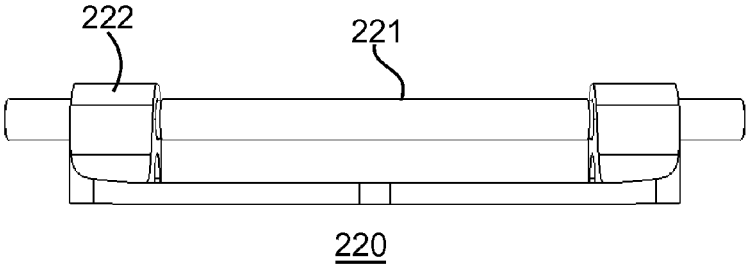
Fig. 17A
Fig. 17B
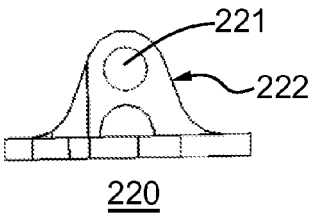

LOCK POSITION

RELEASE POSITION

RELEASE POSITION

LOCK POSITION

LOCK POSITION

RELEASE POSITION

BOOT BINDING SYSTEM WITH FOOT LATCH PEDAL

CROSS REFERENCE TO RELATED APPLICATIONS

This application is a continuation of and claims priority to U.S. Pat. No. 9,126,099, filed 2013 Dec. 27, entitled "Boot Binding System with Foot Latch Pedal," to U.S. Provisional Patent No. 61/778,329, filed 2013 Mar. 12, and U.S. Provisional Patent No. 61/757,216, filed 2013-Jan.-27, said patent documents being herein incorporated in full by reference for all purposes.

GOVERNMENT SUPPORT

Not Applicable.

FIELD OF THE INVENTION

The invention relates generally to boot binding systems for use with snow gliding boards. More particularly, the invention relates to boot binding systems with a toe latch pedal.

BACKGROUND

Back-country splitboarding is a popular sport with a dedicated following. When fully assembled, a splitboard looks like a snowboard, but can be taken apart to form a pair of skis. The right and left "skis" of a splitboard are asymmetrical; i.e., they are the mirror halves of a snowboard—longitudinally cut (or "split"), and typically have the sidecut (i.e. nonlinear long edges) and camber of snowboards. When worn separately as a pair of skis the rider can tour cross-country and climb through soft snow more quickly than by hiking. By joining the ski halves together, the rider descends as if riding a snowboard. The rider's stance in the snowboard riding configuration is sideways on the board, with legs spread for balance.

Because of the combination of functions, where the splitboard is sometimes used for skiing and other times for snowboarding, a great deal of ingenuity has been required in developing boot bindings that can be used in both "touring mode", where the skis are used separately, and "ride mode", where the boot bindings form part of a rigid union between the two ski halves. In both cases, the boot binding may include straps or bails, a heel or toe riser, a heel cup, a highback, and so forth to comfortably secure the boot to the board with a suitable degree of stiffness. Most modern riders use soft boots and flex at the knees and ankles to shift their weight and maneuver the board. The earliest patent applications on splitboards were filed by Ueli Bettenman starting in about 1988, and include Intl. Pat. Nos. CH681509, CH684825, German Gebrauchsmuster DE9108618 and EP0362782B1. In addition to the basic splitboard concept, these patents include drawings of splitboard bindings, both of a slidingly engageable rail type and a rotational clamping type, the bindings serving to secure the rider's boots to the skis in ski mode and the snowboard in ride mode. The earliest efforts at commercialization were made by Snowhow (Thalwil, CH) in Europe, and with the collaboration of the Fritschi brothers, Nitro Snowboards USA out of Seattle in the early 1990's. The Nitro snowboard binding consists of two slider tracks that join paired stationary flanged blocks mounted crosswise on each of the ski members. The binding bails are provided on a second plate which is hinged at the toe on the slider track and can be locked at the heel, thus enabling free heel ski mode when mounted parallel to the long axis of the ski members and ride mode when mounted crosswise. Supplemental stabilizers to hold the tips of the ski members together in ride mode include pairs of buckles.

Also an early contributor was Stefan Schiele, who filed Intl. Pat. Publication WO 98/17355 in 1996 on a three-part board joined by a rigid crosspiece at each foot, each crosspiece engaging three elevated pins with rotatable locking elements and having mating hooks at the ends of the boards. In ski mode, the skier carries the middle piece strapped to his backpack. Commercialization of this product, known as "System T3" continues.

Subsequently, Voile Manufacturing of Salt Lake City filed for a patent on an improved splitboard binding interface. U.S. Pat. No. 5,984,324 describes a slider track with insertable toe pivot pin for each foot, the slider track joining pair of "pucks" mounted on each ski member when mounted crosswise and also serving as a pivotable member for free heel touring. This innovation resulted in substantial growth of interest in splitboarding in the United States and has had worldwide impact on the sport.

Ritter, in U.S. Pat. Nos. 7,823,905, 8,226,109 and in US Pat. Appl. Publ. No 2013/025395, disclosed a stiffer, lower and lighter binding for spanning pucks mounted crosswise on the splitboard. The lightweight binding includes a toe pivot for free heel skiing and touring and has gained popularity among soft boot riders. These bindings are being commercialized by Spark R&D of Bozeman Mont. Maravetz, in U.S. Pat. No. 6,523,851, abandoned the rail-type binding in favor of a clamp designed to engage a pair of semi-circular flanged mounting blocks, one pair under each foot in ride mode. The two mounting blocks conjoin as a circle on which the jaw mechanism can be adjusted to suit the foot angle of the rider. Boot bindings are attached to the upper surface of the clamp member. Interestingly, the jaw of the clamp operates to tighten itself against the board and pull the two ski members together. However, the complexity of the mechanism is a disadvantage in that impacted snow tends to interfere with its operation. The clamp is provided with a built in toe pivot mechanism that is used in ski mode. The board is stabilized with front and rear hooks that join the ski members.

U.S. Pat. No. 8,033,564 to Riepler is under commercialization by Atomic (Altenmarkt Im Pongau, AT). The Atomic splitboard binding interface uses a rotating plate that engages four mushroom pins affixed to the ski members under each of the rider's feet. The rotating plate also operates a locking device for engaging a crampon tool. The internal workings are mounted between two plates that make up the body of the binding. The built-in toe pivot pin is spring-loaded in a sealed cylinder and engages a toe pivot cradle in ski mode. Ride mode configuration is stabilized by front and rear buckles and tip hooks. The ski members are unique in that they are shaped with a pointed downhill tip and a rounded tail. A well-known drawback of this interface is the need for a special spanner tool to transfer the binding between ski mode to ride mode.

U.S. Pat. Publ. No. US2010/0102522 to Kloster discloses two binding interface systems that appear to combine a number of features, including buckles and hooks for stabilizing the ski tips in ride mode. The Kloster binding is commercialized by Karakoram (North Bend, Wash.). In ski mode, a non-detachable axle at the toe is engaged by a pair of jaws operated by a release lever built into the toe pivot cradle. To disengage the toe axle from the pivot cradle, the rider lifts his boot heel and reaches under his foot to pull up the release lever (or removes the boot and reaches through the binding). A doubly-hinged linker arm couples the rotation of the release lever and the disengagement of the locking jaw.

In ride mode, the toe end is affixed to a pair of tabs mounted on a first ski member and a side lever arm operated by the rider causes extendable rods at the heel end to engage brackets mounted to the second ski member. As the side arm lever is rotated and locked, the two ski members are pulled together. The ride mode engaging system is sealed in a gear box to prevent snow entry, which would jam the workings. In ski mode, the toe end engages a toe pivot interface and requires its own lever-operated clamping mechanism. The use of two separate mechanisms for the toe pivot and ride mode interfaces adds complexity and weight.

Thus, there is a need in the art for a splitboard binding interface that overcomes the above disadvantages and provides the further improvements as will be apparent from the disclosure contained herein.

BRIEF SUMMARY

Described is a boot binding system for riding a snow gliding board. The system includes a pair of boot bindings, each member of the pair having a baseplate-latching toe pedal combination for supporting the rider's boot. The baseplate combination includes a pivotable toe latch pedal mechanism at the toe end. The latching mechanism engages, in alternation, a ride mode interface and/or a ski touring mode interface mounted on a gliding board. The toe pedal mechanism operates to interchangeably secure the boot binding baseplate to either of the interfaces so that the rider may take turns in ski mode and ride mode. In ski touring mode, the toe latch pedal mechanism engages for example pintle pins or a toe pivot axle shaft. In ride mode, for example, a detent member may operate to capture the baseplate on a pair of mounting pucks. In ski touring mode, the same detent member may operate to lock the baseplate to pivot pins. In a first position the toe latch pedal mechanism is raised and disengaged so that the baseplate may be reversibly detached or switched between ski touring configuration and ride mode configuration. In a lock position, the rider locks each boot binding in ride mode or ski touring mode by depressing a toe pedal plate when stepping into the boot bindings. The toe pedal remains under the boot toe when locked in place.

The toe pedal plate is pivotably mounted in mounting box slot cut or otherwise formed in the toe end of the baseplate. Paired hinge arms or other pivot means allow the toe pedal plate to pivot from a first, raised position angled up from the baseplate to a second, depressed position where the toe pedal plate is essentially co-planar with the baseplate. When the toe latch pedal mechanism is up and open, the bindings may be removed from their attachment and repositioned for either ski touring mode or ride mode, or from one board to another. When the rider's foot or fingers are used to depress the toe latch pedal into its lock position, the boot binding is locked to the selected interface.

Advantageously, a single moving part serves multiple functions in engaging either interface. The invention eliminates pins of the prior art that sometimes were lost during changeovers from touring to ride mode, and is robust, durable and resists snow impaction in the mechanism. The invention is an improvement over complex mechanisms of the prior art, some using separate locks for touring and ride mode, and is an advance in the art. The simplicity is reflected in that the locking mechanism may be actuated using only the rider's boot toe.

In a first embodiment of FIGS. 1 through 15, the ride mode interface is compatible with mounting pucks affixed to a splitboard. The slider track engages flanged edges of the pucks and is locked on the pucks by toe pressure on the pedal plate. In ski mode, pintle pins mounted on paired nose members of the baseplate engage mated pivot holes of a ski touring mode interface. A detent member affixed to the underside of the toe pedal plate is used to lock the boot binding to the selected interface.

In a second or alternate embodiment of FIGS. 16 through 28, the toe latch pedal feature is incorporated into a dual mode binding interface. Anchor pins mounted on a board surface form the ride mode interface. In this example, a dogging bolt in the underside of the baseplate engages the anchor pins and locked onto the interface by toe pressure on the pedal plate. In ski mode, detent members mounted on the toe pivot plate engage a toe pivot axle.

Thus in more generality, the invention is a family of boot binding and interface systems for riding a gliding board, which comprise a baseplate-toe latch pedal mechanism that engages a ski touring interface or a ride mode interface interchangeably. The system comprises a ride mode interface (such that the ride mode interface is attachable to a gliding board surface); a ski touring mode interface (such that the ski touring mode interface is attachable to a gliding board surface), and a baseplate-latching toe pedal combination, characterized in that the baseplate-latching toe pedal combination comprises a) a baseplate, the baseplate having a posterior aspect, an anterior aspect, a top surface, an undersurface; b) a pair of nose members (108, 253) contralaterally disposed on the anterior aspect of the baseplate, the nose members defining a mounting box slot (109, 209) therebetween, the mounting box slot having an anterior open end and a posterior closed end, and c) a toe latch pedal mechanism pivotably mounted to the baseplate such as at the posterior closed end of the mounting box slot, the toe latch pedal mechanism having a toe end, a heel end, and a toe pedal plate with top face, the toe latch pedal mechanism having a release position (FIGS. 8A, 12A, 23B) such that the toe end of the toe pedal plate is pivoted out of the mounting box slot so as to be elevated above the top surface of the baseplate and a lock position (FIGS. 8B, 12B, 23A) such that the top face of the toe pedal plate is pivoted into the mounting box slot so as to be essentially co-planar with the top surface of the baseplate when lockingly engaged in alternation or in turn to the ride mode interface or the ski touring mode interface. In the lock position, the toe pedal plate supports the toe aspect of a rider's boot, and the bindings are free to pivot at the toe in ski touring mode or are locked to the surface of the gliding board in ride mode.

A boot binding and interface system of the invention typically will include two gliding board interfaces: a ride mode interface and a ski touring mode interface. For operation with a splitboard, both interfaces are used in turn. For operation on a snowboard, however, only the ride mode interface is used. Thus one interface engagement system may be used for both splitboard riding (in either ride mode or ski touring mode) and snowboard riding (in ride mode) in alternation. Advantageously, a boot binding and interface system of the invention enables a splitboard rider to engage the ride mode interface or the ski touring mode interface interchangeably. Yet more advantageously, the toe latch pedal is enabled to be lockingly operated with only a rider's boot toe. In one aspect of the invention, the ski touring mode interface comprises a toe pivot bracket or cradle having medial and lateral toe pivot ears, each of the toe pivot ears having a coaxial pivot hole transversely disposed therein, such that the toe pivot bracket is attachable to a gliding board. Each of the nose members includes a pintle pin or equivalent. The pintle pins are ipsilaterally disposed (each on the same side) on the nose members and define a toe pivot axis when cooperatively inserted into the coaxial pivot holes of the toe pivot ears with a coordinated sideways installation motion.

In another aspect of the invention, the boot binding and interface system includes a toe pivot axle shaft disposed in coaxial pivot holes of the ski touring mode interface, the pivot axle shaft extending mediolaterally from medial and lateral toe pivot ears of a toe pivot bracket, the nose members having hooked ends for hookingly engaging the mediolateral extensions of the shaft, such that the hooked ends define a toe pivot axis when cooperatively engaged on the pivot axle.

In yet another aspect of the invention, the ride mode interface comprises a pair of "pucks", and the pucks are attachable to a gliding board. To accommodate the pucks, the undersurface of the baseplate is formed with a box channel having internal flanges for slideably, receivingly and conjoiningly gripping the pair of pucks to the baseplate. The detent lockingly captures the pucks inside the box channel. In an alternative embodiment, the ride mode interface comprises anchor pins with retaining slots laterally disposed on the pins, such that the anchor pins are attachable to a gliding board. To engage the anchor pins, the undersurface of the baseplate comprises for example a dogging bolt operated by cam drive studs inferiorly disposed on each side of the toe latch pedal mechanism, the dogging bolt operating to engage the retaining slots of the anchor pins when the toe latch pedal is in the lock position and to disengage the slots in the release position.

Also provided is a method for securing a boot binding to a ride mode interface or a ski touring mode interface in alternation. The method includes steps for (a) providing a gliding board having a ride mode interface and a ski touring mode interface, (b) providing a boot binding baseplate having a toe latch pedal mechanism mounted anteriorly thereon, the toe latch pedal mechanism comprising a pivotable toe pedal plate with detent member inferiorly mounted thereon; and, (c) pivoting the toe pedal plate between a release position and a lock position when lockingly engaging either the ski touring mode interface or the ride mode interface in turn. The toe pedal plate has a top face used for applying the rider's toe so as to lockingly engage an interface, and when locked in place, the toe pedal plate continues to support the rider's boot toe as part of the foot supporting surface of the binding.

Riders having a gliding board (such as a snowboard) equipped with only a ride mode interface and a second gliding board (such as a splitboard) equipped with both a ride mode and a ski touring mode interface, advantageously may use either board with a single boot binding system without the need for any modification. A single toe pedal latching mechanism works with both board types and both interfaces.

The foregoing and other elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps and combinations thereof that characterize aspects the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIG. 16 is an elevation view of the boot binding system of FIG. 15. Shown is the toe latch pedal mechanism in an upright, disengaged position.

FIGS. 17A and 17B are a front elevation view and a side elevation view of a ski touring mode interface having a toe pivot cradle and a toe pivot shaft.

Figure 1:
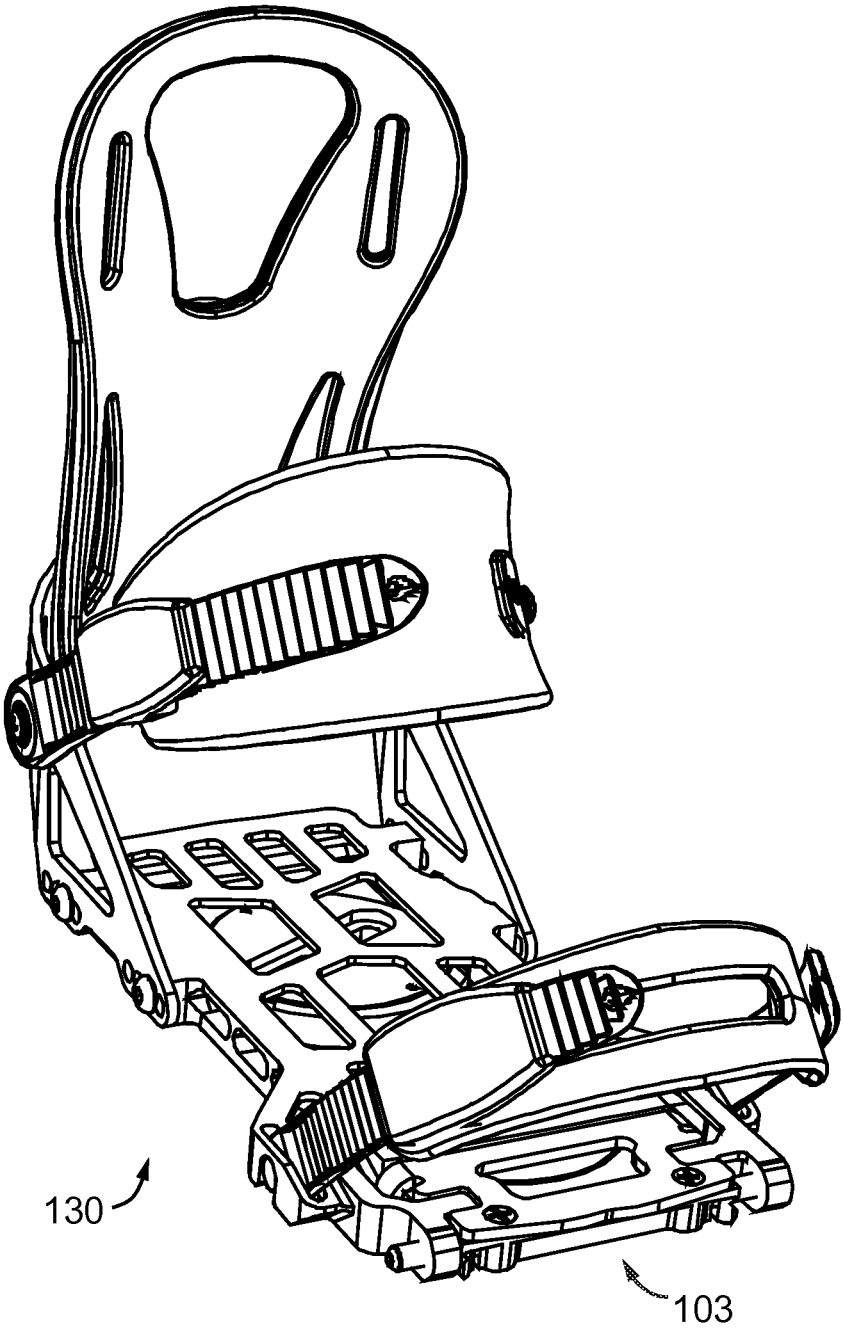
FIG. 1 is a perspective view of a first exemplary boot binding system of the invention as configured for ride mode.

The drawing figures are not necessarily to scale. Certain features or components herein may be shown in somewhat schematic form and some details of conventional elements may not be shown in the interest of clarity and conciseness. The drawing figures are hereby made part of the specification, written description and teachings disclosed herein.

DETAILED DESCRIPTION

Although the following detailed description contains specific details for the purposes of illustration, one of skill in the art will appreciate that many variations and alterations to the following details are within the scope of the claimed invention. The following definitions are set forth as an aid in explaining the invention as claimed.

DEFINITIONS AND TERMINOLOGY

Snow gliding boards may include either snowboards or splitboards, splitboards having two mating halves forming ski members that function as snow gliding boards when separated or when joined together as a splitboard.

A ski touring mode interface is an assembly affixed to a gliding board, the interface having a toe pivot bracket or cradle for pivotably mounting a boot binding thereon. The ski touring configuration is used for ski touring mode.

A ride mode interface is an assembly affixed to a gliding board so that a rider can ride with legs spread and body generally sideways on the board. The ride mode configuration is used for ride mode, in which a gliding board is ridden in the manner of a snowboard. Ride mode interfaces may optionally comprise paired members, such that one member of each pair is affixed to one half of a gliding board having two separate halves, so that when the boot binding is engaged thereon, the halves of the gliding board are joined to each other. Gliding boards operating on this principle were first described by Ueli Bettenman starting in about 1988, and include Pat. Doc. Nos. CH681509, CH684825, German Gebrauchsmuster DE9108618 and EP0362782B1.

"In alternation" or "in turn" refers to interchanging the position of a the boot binding system between a first interface and a second interface, and includes swapping the system between a ride mode interface and a ski touring mode interface, but may also include switching the system from one gliding board to another board having a compatible interface. Thus any combination of interfaces may be selected in turn because the engagement mechanism enables attachment to any of them.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," "toeward" is relative to the term "heelward," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. The various components, features, steps, or embodiments thereof are all "preferred" whether or not it is specifically indicated. Claims not including a specific limitation should not be construed to include that limitation. The term "a" or "an" as used in the claims does not exclude a plurality.

Unless the context requires otherwise, throughout the specification and claims that follow, the term "comprise" and variations thereof, such as, "comprises" and "comprising" are to be construed in an open, inclusive sense—that is as "including, but not limited to."

Exemplary Technical Features

This invention is related to a boot binding system combination having one or two interfaces for riding a gliding board. The invention relates to a toe pedal or latch actuator mechanism operative to reversibly attach a boot binding baseplate to a toe pivot bracket or cradle in ski touring mode, and in a preferred embodiment, the same toe pedal mechanism operates to reversibly attach the boot binding baseplate to a ride mode interface. Advantageously, the toe pedal system reduces the number of moving parts to one, and eliminates the locking or clevis pins of the prior art, which are easily lost.

Preferred boot binding systems described herein include one or more of the following features: each member of a pair of boot bindings is provided with a baseplate for supporting the rider's boot, where the baseplate includes a hinged toe latch pedal at the toe end, the toe latch pedal having a detent means that operates to secure the baseplate to the board in one of two configurations. In ride mode, the detent means may operate to immobilize the baseplate on a pair of mounting pucks. In touring mode, the detent means will operate to attach the baseplate so as to permit pivoting of the baseplate on a pair of toe pivot pintle pins or on an axle mounted through toe pivot ears.

In a first position the toe pedal detent is raised and disengaged from any contacting members so that the baseplate may be reversibly detached or switched between touring mode configuration and ride mode configuration. The rider locks each boot binding in ride mode or touring mode by stepping onto the baseplate and depressing the toe latch pedal so as to contactingly engage the detent member with the chosen board interface members. In touring mode, the toe latch pedal engages pivot members of a toe pivot bracket or cradle. In ride mode, the toe latch pedal engages mounting pucks which are affixed to the splitboard.

FIG. 1 is a perspective view of a first exemplary boot binding system of the invention in ride mode configuration 130. In this mode, the complete boot binding ride mode system 100 is enabled to be affixed to a snow gliding board using two mounting pucks visible through the cutouts of the baseplate. The board itself is not shown, but the combination is demonstrated in FIG. 11 and FIG. 14A, where ride mode is illustrated. Also shown is a latching toe pedal mechanism 103 as will be described below. The complete boot binding system 100 may include conventional accessory features of a boot binding system, including toe and ankle straps and highback for example. Toe and ankle straps may include ratchet buckles as shown and optionally a rip cord attached to the release handles of the buckles for emergency release of the boots from the bindings (as in an avalanche). Optionally, any combination of accessory features may be supplied by other manufacturers to be compatible with a boot binding baseplate, toe latch pedal, and gliding board interfaces of the invention.

Figure 2:
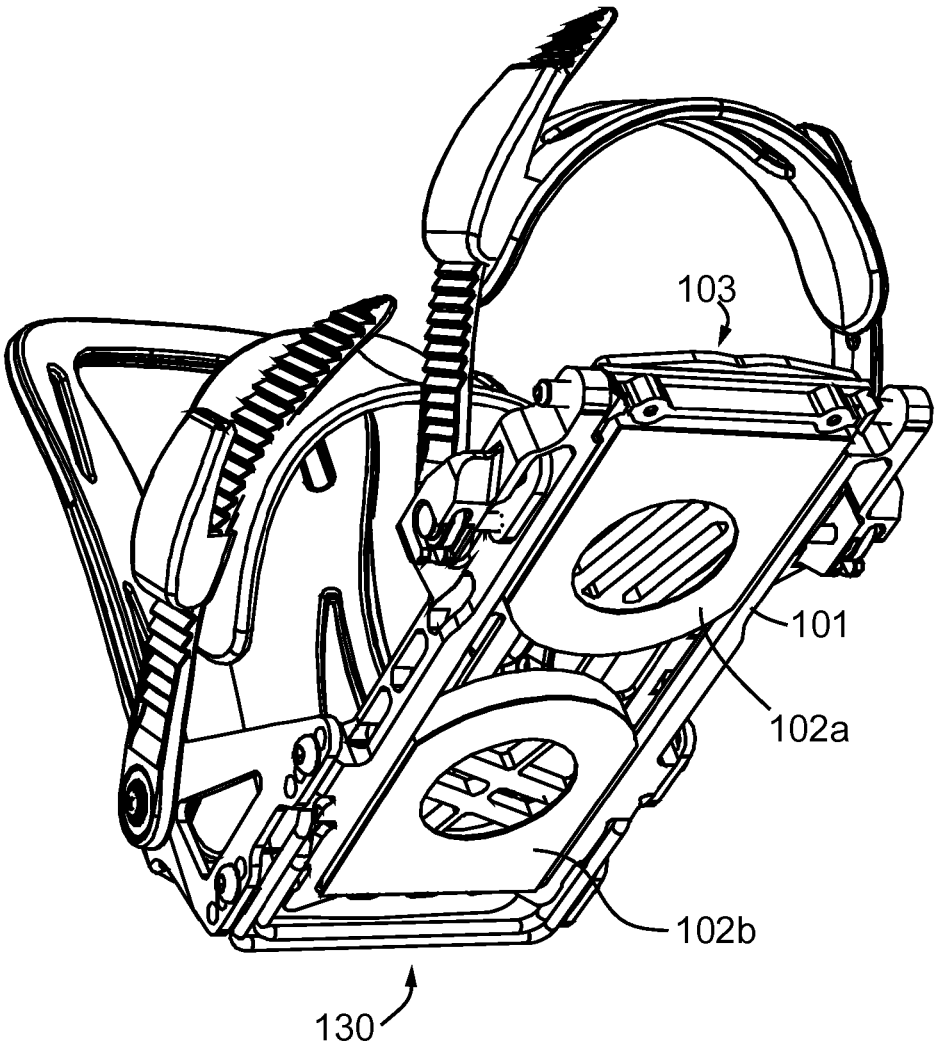
FIG. 2 is a perspective view of the underside of a boot binding system with mounting pucks in place.

FIG. 2 is a perspective view of the underside of a boot binding system with boot binding baseplate 101 and toe latch pedal mechanism 103. When mounted on a first ride mode interface (mounting pucks 102*a*, 102*b*), the combination is termed ride mode configuration 130. The mounting pucks are locked in place in a flanged channel by a detent mounted on a novel toe pedal as will be described in more detail below. Mounting pucks of this kind are known in the art and are described more fully in U.S. Pat. No. 5,984,324 to Wariokois, U.S. Pat. No. 7,823,905 to Ritter, and US Pat. Appl. Publ. No. 2012/0256395 to Ritter, all being incorporated in full herein by reference. However, the system presented here eliminates the need for retaining pins and cables or tethers to capture the hardware. Advantageously, the system operates with dual mode capability (ride mode and ski touring mode), having a single moving part (and no disassembly required) to switch from one mode to the other. Surprisingly, the rider finds one hand free to hold the gliding board when moving the binding assembly from one interface type to the other and can lock the boot binding system onto an interface with only the toe of a boot. Also shown are optional conventional boot binding elements including a toe strap, ankle strap, heel cup and heel riser.

Figure 3:
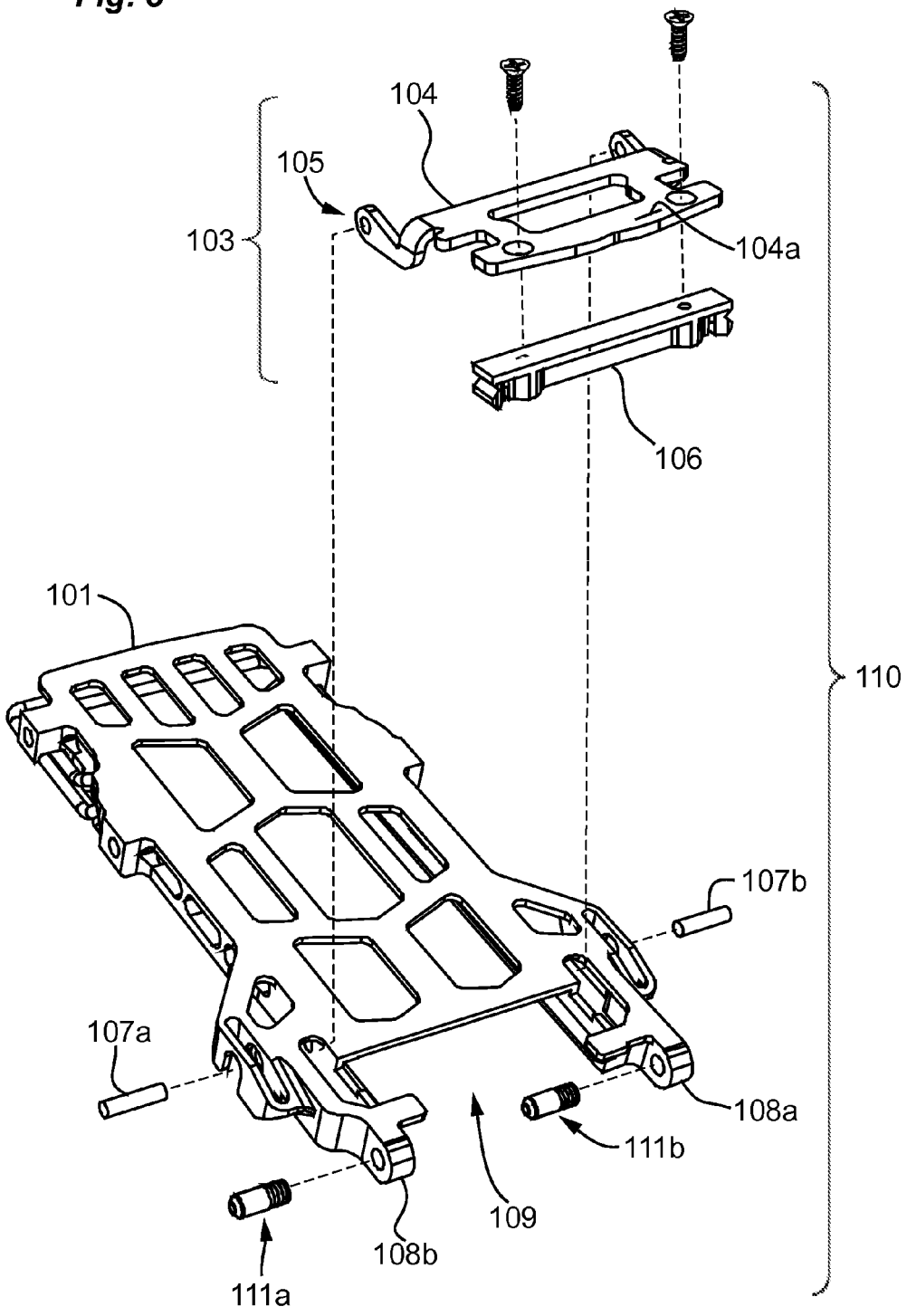
FIG. 3 is an exploded view of a boot binding baseplate with toe latch pedal assembly.
Figure 8A:
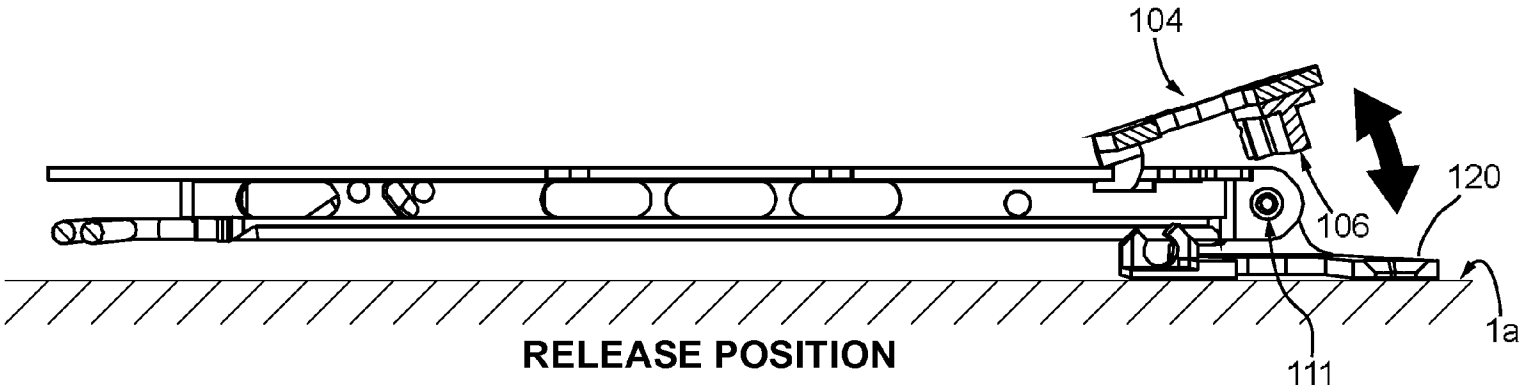
FIGS. 8A and 8B are section views showing the operation of the toe latch pedal in ski touring mode.
Figure 8B:
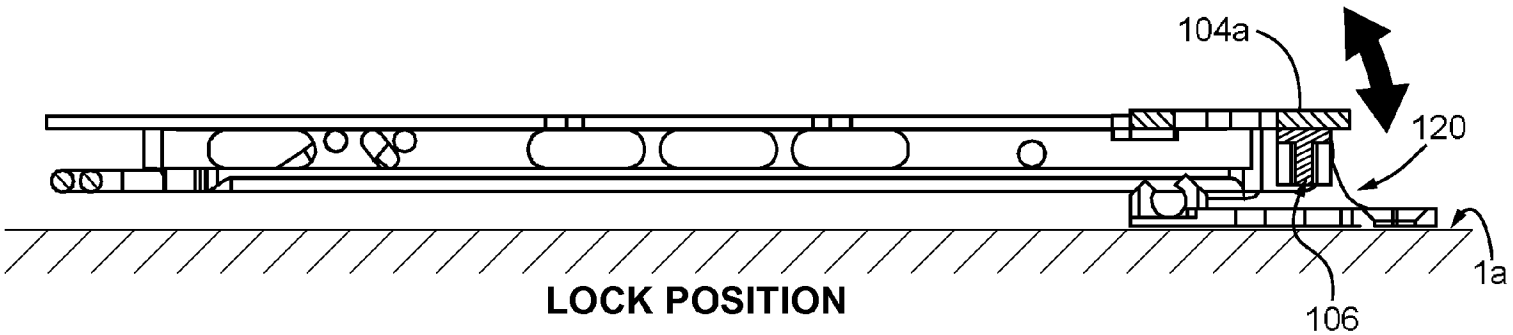

FIG. 3 is an exploded view of a baseplate-latching toe pedal combination 110. The latching toe pedal mechanism 103 includes a toe pedal plate 104 with hinge arms 105 and a detent member 106. Detent members having dimensions and stiffness suitable for interference capture of the mounting pucks in a flanged channel under the baseplate are contemplated without limitation. The toe pedal plate pivots on pivot pins 107*a* and 107*b*. The toe pedal plate is provided with a pedal top face 104*a* for engaging a rider's boot toe. The detent also serves to lock pintle pins (111*a*, 111*b*) in a ski touring mode interface as will be described below. Pintle pins 111*a* and 111*b* are not used in ride mode, but come into play in ski touring mode, as will be described below. A mounting box slot 109 for the pedal plate assembly is formed by inside edges of nose members 108*a*, 108*b* and a cutout from the baseplate. The toe pedal top face 104*a* and baseplate 101 are co-planar when the toe pedal is not pivoted up, as shown in FIGS. 8A and 8B. The combination assembly 110 is defined by baseplate 101 with toe pintle pins 111*a* and 111*b*, and toe pedal mechanism 103 on hinge pins 107*a* and 107*b*, and reversibly engages either a ski touring mode interface or a ride mode interface when in use by a rider. Duality of function is a characteristic of the boot binding systems of the invention.

Figure 4:
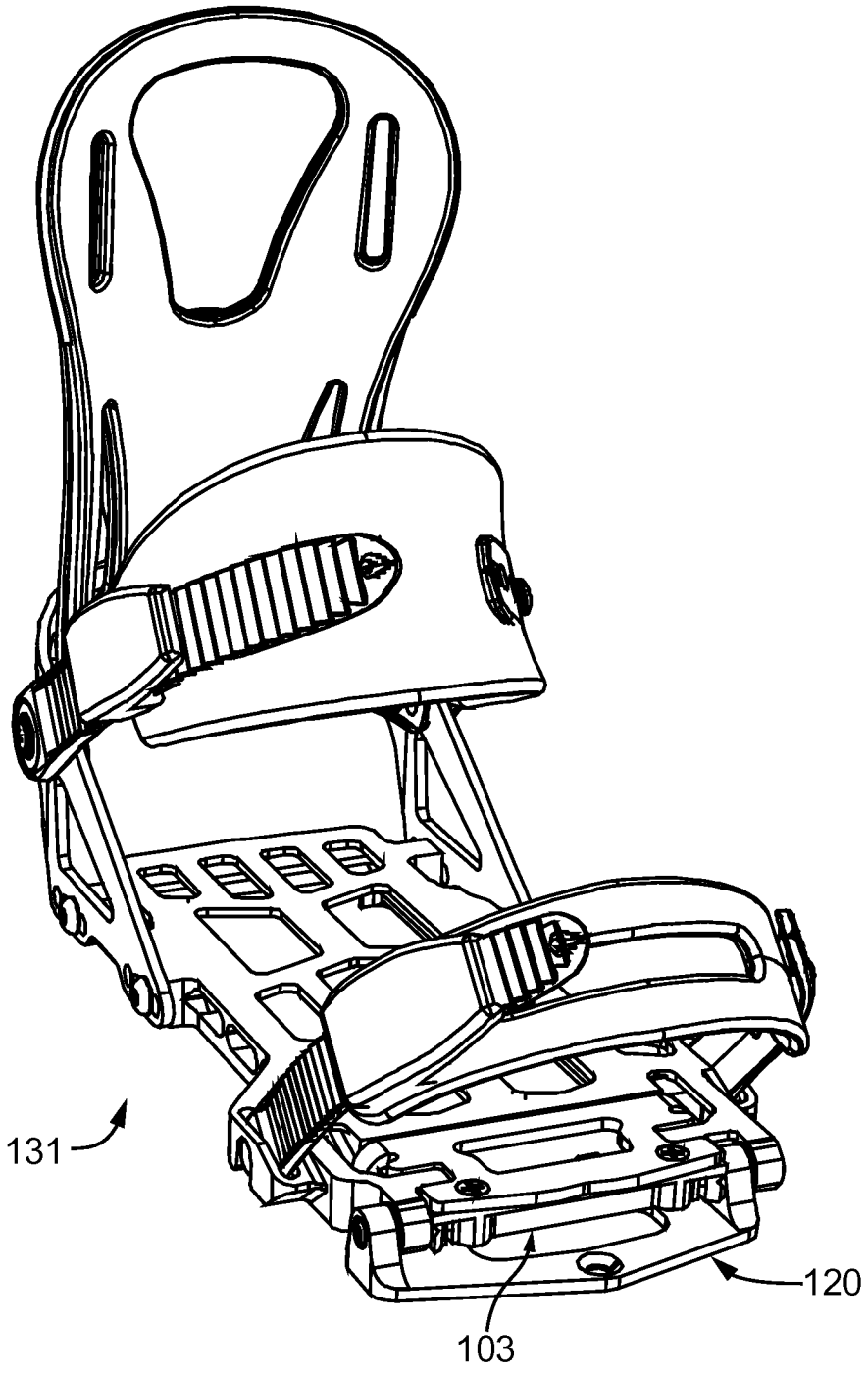
FIG. 4 is a perspective view of an exemplary boot binding system of the invention as configured for ski touring mode.

FIG. 4 is a perspective view of an exemplary boot binding system of the invention as configured for ski touring mode with a ski touring mode interface 120. The boot binding baseplate system in ski touring configuration 131 is pivotable at the toe, and attaches to a gliding board ski member through a toe pivot cradle or bracket 120 that functions as a ski touring mode interface. As visible here, toe pedal mechanism 103 is locked onto the ski touring mode interface by detent member 106.

Figure 5:
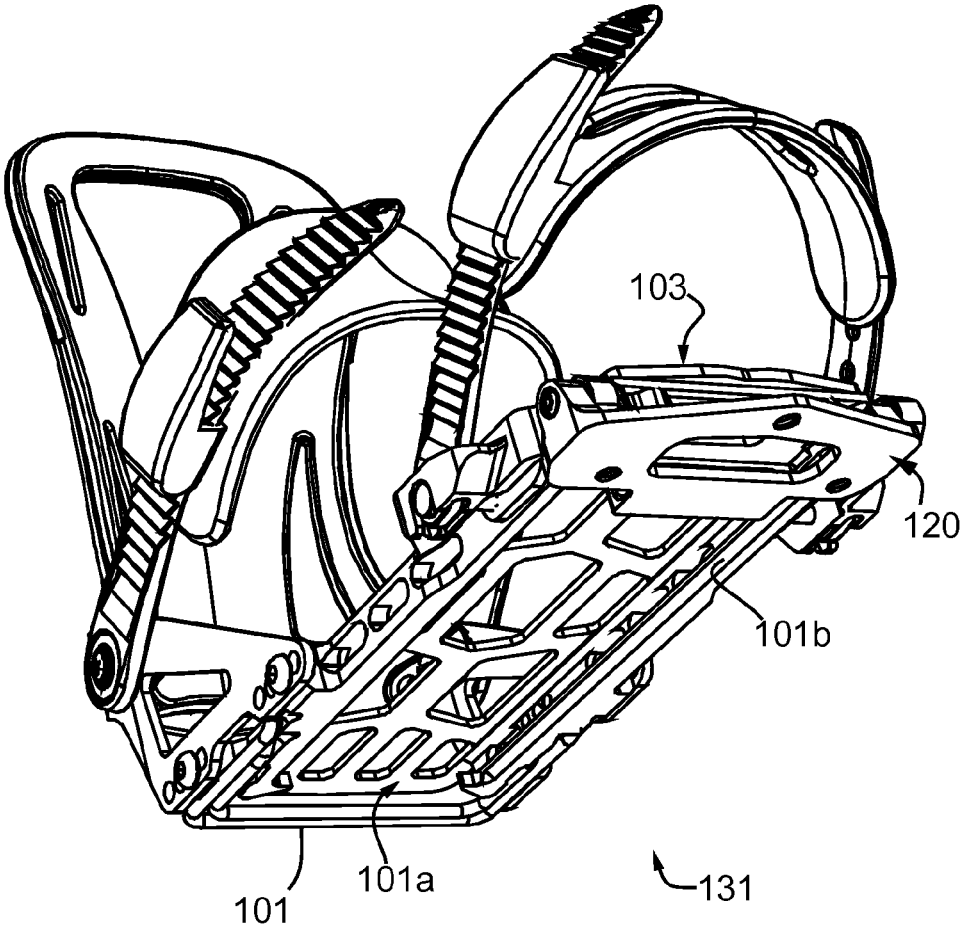
FIG. 5 is a perspective view of the underside of a boot binding system with toe pivot cradle attached.

FIG. 5 is a perspective view of the underside of a boot binding baseplate system in ski touring configuration 131 with ski touring mode interface 120 attached. A three point system of fasteners is used to affix the toe pivot bracket 120 to a top surface of a gliding board ski member. The underside of the baseplate 101 is generally characterized as having a long axis box channel 101*a* disposed between lateral rails, the lateral rails with inside flanges 101*b* for gripping the ride mode interface as will be described below.

Figure 6:
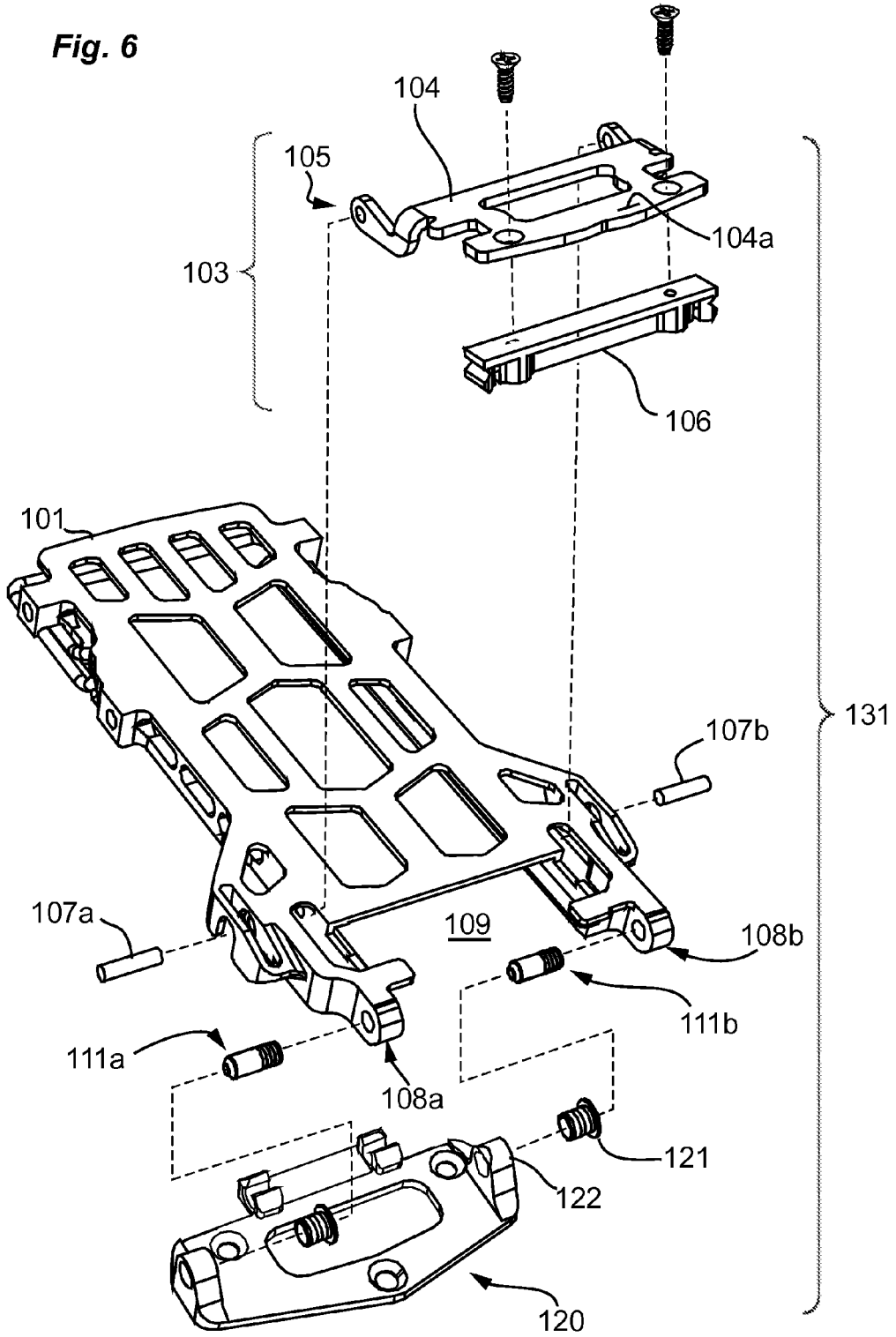
FIG. 6 is an exploded view of a boot binding baseplate with toe latch pedal assembly and toe pivot cradle.

FIG. 6 is an exploded view of a boot binding baseplate-toe latch pedal mechanism combination 110 having baseplate 101 and latching toe pedal feature 103. Also shown is ski touring mode interface (also termed "toe pivot cradle", 120), the complete assembly forming ski touring configuration 131. The toe latch pedal mechanism 103 includes a toe pedal plate 104 with hinge arms 105 and a detent member 106. Toe pedal plate upper face 104*a* is provided for engaging the rider's boot toe. The toe pedal plate is hinged and pivots on pivot members 107*a* and 107*b* as shown by dashed lines. A mounting box slot 109 for the pedal plate assembly is defined between an anteriorly extending jaw formed by nose members 108*a* and 108*b*, which engage toe pivot pintle pins 111*a* and 111*b*. The toe pivot pintle pins are designed to be inserted into holes in the toe pivot ears 122, which are shown here with bushings 121. The pintle pins are inserted with an ispilateral motion (from one side). When the detent member is lowered into the locking position between the first anterior nose member 108*a* and the inside face of the opposing toe pivot bracket, toe pivot pintle pins 111*a* and 111*b* cannot be disengaged from the anterior nose members (108*a*, 108*b*), but the baseplate combination is free to pivot up and down at the heel, permitting "free heel" skiing and touring.

Figure 7:
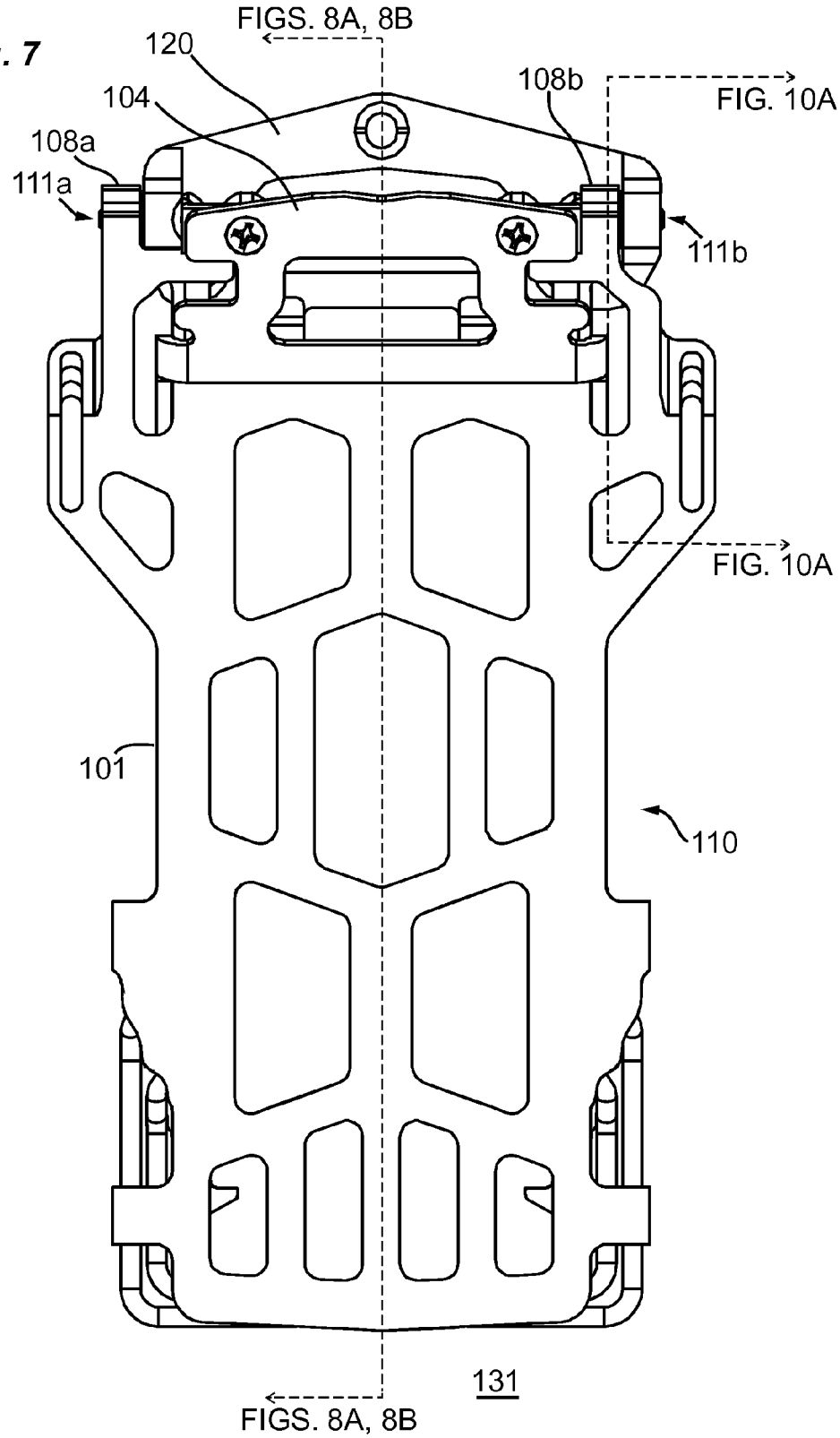
FIG. 7 is a plan view of a baseplate from the top. The toe latch pedal plate is in an elevated, open position. Also shown is a toe pivot cradle.
Figure 10A:
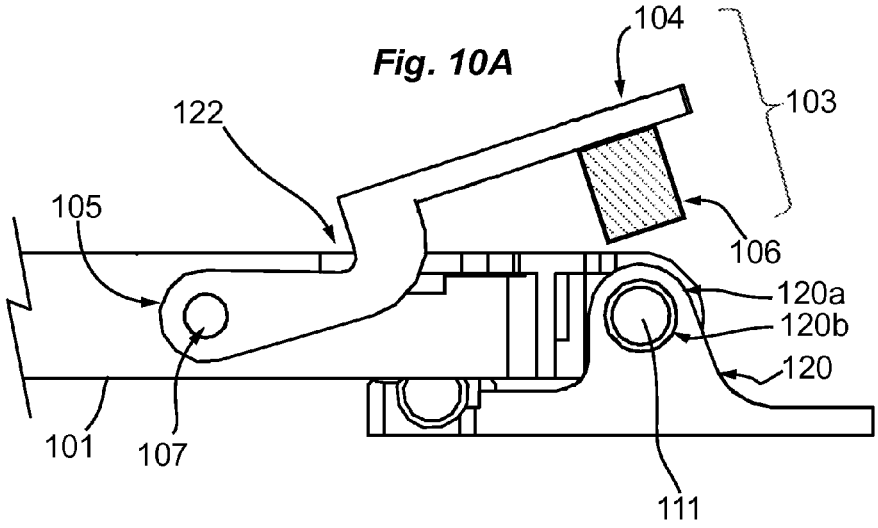
FIG. 10A is a cutaway view drawn to expose the hinge arm of the toe latch pedal plate.

FIG. 7 is a plan view of a baseplate and toe pedal combination 110 from the top. The toe latch pedal plate 104 is in an elevated, angular, open position. Also shown is a ski touring mode interface 120. The position of section cuts depicted in FIGS. 8A, 8B and 10A are drawn for reference. Baseplate 101 includes anterior nose members (108*a*, 108*b*) and pintle pins (111*a*, 111*b*). In combination, the baseplate-toe latch pedal combination 110, when mounted on ski touring mode interface 120, form ski touring configuration 131.

FIGS. 8A and 8B are section views showing the operation of the toe latch pedal in touring mode. Pedal plate 104 opens and closes as shown (arrows), forcing the detent member 106 in and out of the ski touring mode interface 120, where impingement prevents disengagement of the baseplate from the toe pivot pintle pins 111. The ski touring mode interface is shown affixed to a gliding board upper face 1*a*. FIG. 8A shows the raised position of the latching toe pedal in RELEASE POSITION; FIG. 8B shows the depressed position of the latching toe pedal in its LOCK POSITION. The toe pedal plate 104 and detent 106 are visible in the mounting box slot (109, FIG. 6) in this sectional view. Toe pedal upper face 104*a* is shown to be co-planar with the baseplate in the LOCK POSITION. In FIG. 8B the detent obstructs the view of pintle pin 111.

Figure 9A:
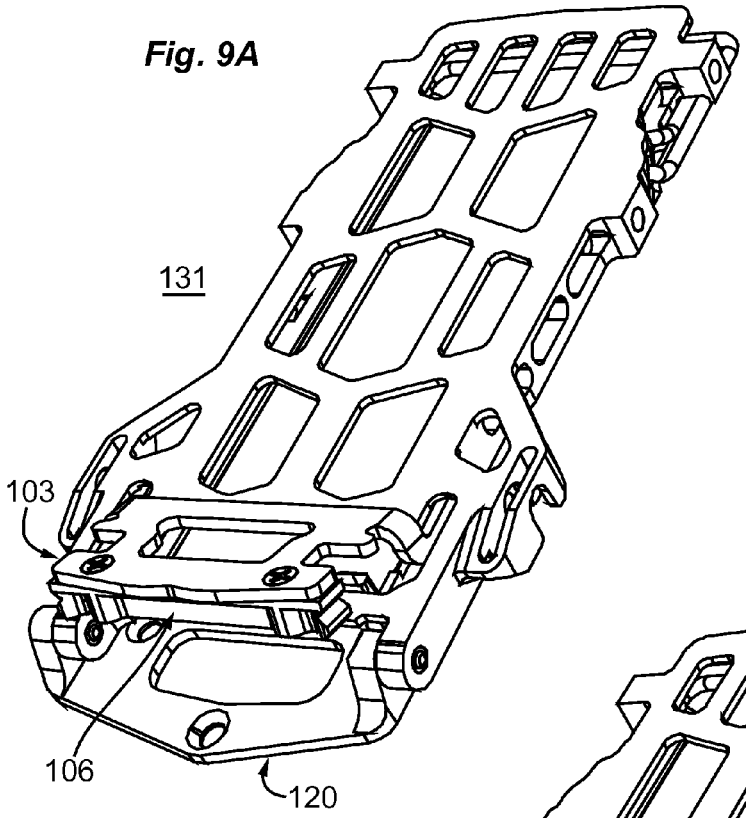
FIGS. 9A and 9B are perspective views of the baseplate showing the operation of the toe latch pedal mechanism in ski touring mode.
Figure 9B:
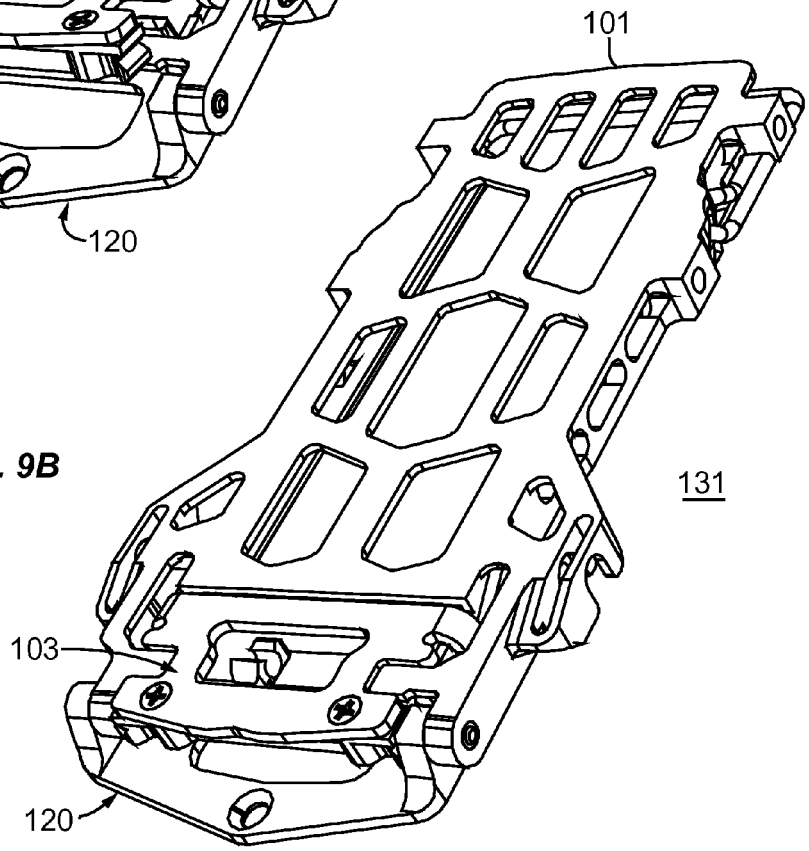

FIGS. 9A and 9B are perspective views of the interface engagement mechanism showing the operation of the toe latch pedal in ski touring configuration 131. In FIG. 9B, latching toe pedal assembly or mechanism 103 is reversibly depressed (such as by the action of a rider's boot toe) so as to lock the baseplate toewise onto a ski touring mode interface 120. Detent 106 is again shown to obstruct the exit of the pintle pins from anterior nose members or pivot ears (108*a*, 108*b*, FIG. 7) when in the locked position.

FIG. 10A is a cutaway view drawn to expose the hinge arm 105 and pivot of the toe latch pedal mechanism 103. The hinge arm extends through a slot 122 in the baseplate 101 and is seated on an offset pivot axle 107. Also shown is an end view of toe pivot pintle pins 111 inserted into holes 120*b* in pivot ears 120*a* of toe pivot bracket or cradle (ski touring mode interface, 120). Detent member 106 locks the pintles in the ski touring mode interface 120 in ski touring mode and is mounted inferiorly at the toe end of toe pedal plate 104.

Figure 10B:
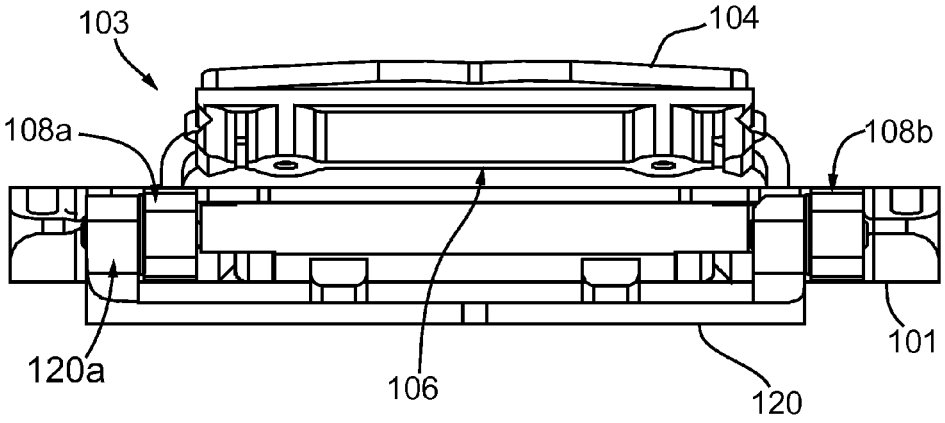
FIG. 10B is an elevation view of the toe end of a baseplate with toe latch pedal and toe pivot cradle.

FIG. 10B is an elevation view of the toe end of a baseplate with latching toe pedal mechanism 103 and toe pivot bracket or cradle 120 forming the ski touring mode interface. The hinge arm and pedal plate are dimensioned so that detent member 106 drops between toe pivot ears 120*a* of toe pivot cradle 120 to block lateral disengaging movement of the baseplate when the pedal plate is pushed down. Pintle pins (FIG. 6, 111*a*, 111*b*) are mounted ispilaterally on anterior nose members (108*a*, 108*b*) of the baseplate and insert with a coordinated horizontal motion into the corresponding pivot holes in toe pivot ears 120*a*. The detent member 106 is flared at both ends to form a rigid wedge between the inside face of the baseplate nose member 108*a* and a contralateral inside face of the toe pivot bracket 120 in the LOCK POSITION. When the toe pedal is raised, the baseplate is disengaged from the toe pivot ears by an opposite horizontal motion.

Figure 11:
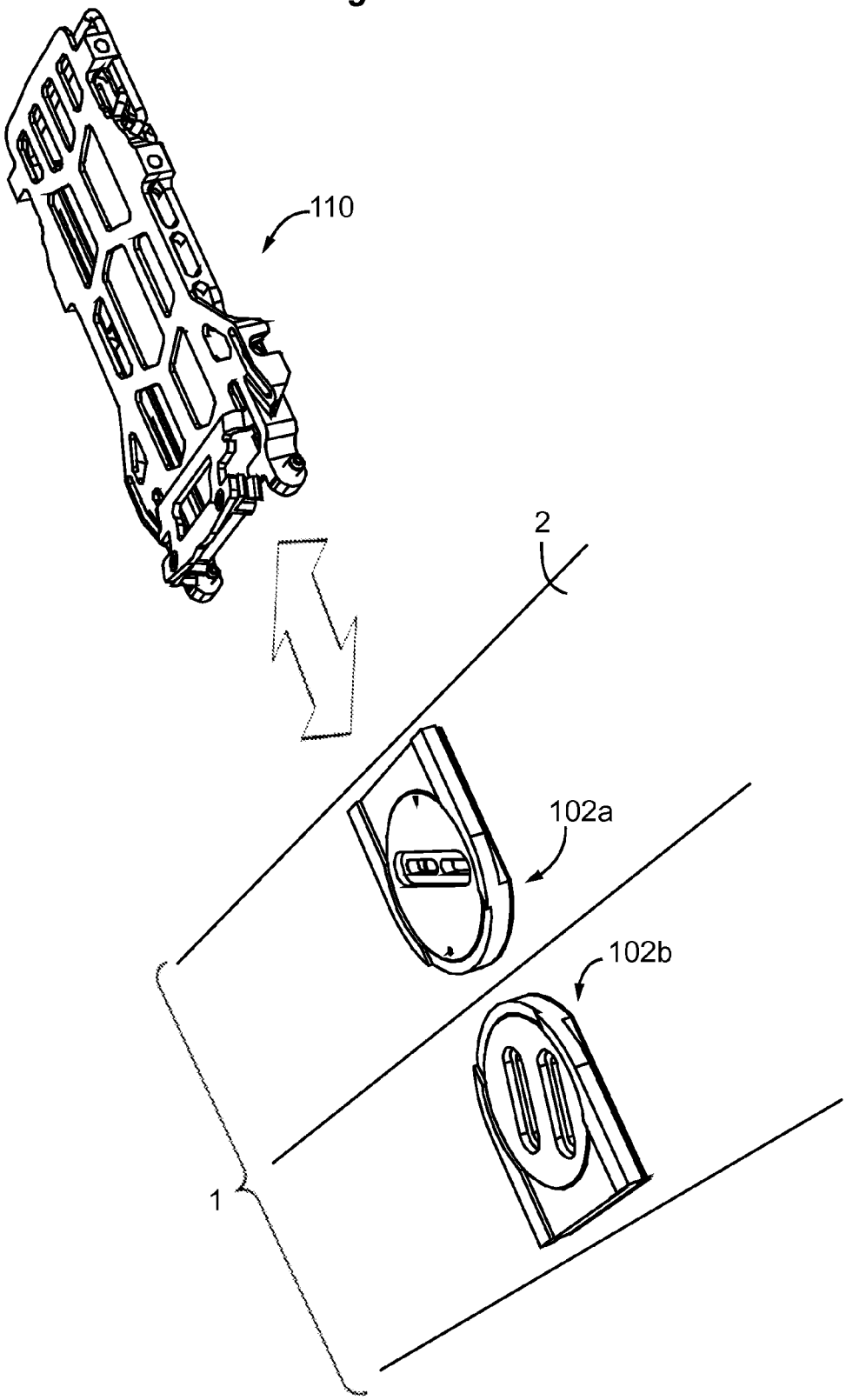
FIG. 11 is a schematic illustrating the process of attaching a baseplate to a pair of mounting pucks on the ski halves of a splitboard. The toe latch pedal is in the open position, and when the pucks are fully engaged on mating flanges on the underside of the baseplate, the toe latch pedal is depressed to lock the baseplate onto the pucks.

FIG. 11 is a schematic illustrating the process of attaching a baseplate to a pair of mounting pucks on the ski halves 1 of a splitboard 2. The toe latch pedal is in the open position, and when the pucks are fully engaged on mating flanges on the underside of the baseplate, the toe latch pedal is depressed to lock the baseplate onto the pucks. The duplex arrow indicates that the boot binding may be engaged or disengaged by sliding the baseplate on or off the mounting pucks (102*a*, 102*b*). Mating flanges on the pucks and the underside of the baseplate ensure a tight fit.

Figure 12A:
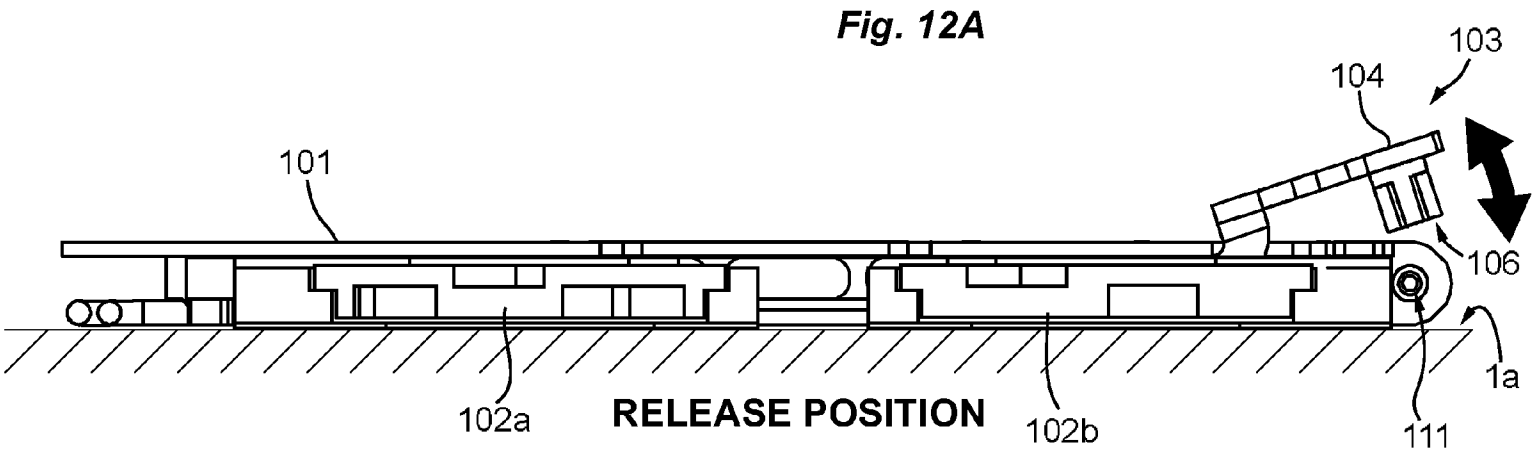
FIGS. 12A and 12B are section views showing the operation of the toe latch pedal in ride mode.
Figure 12B:
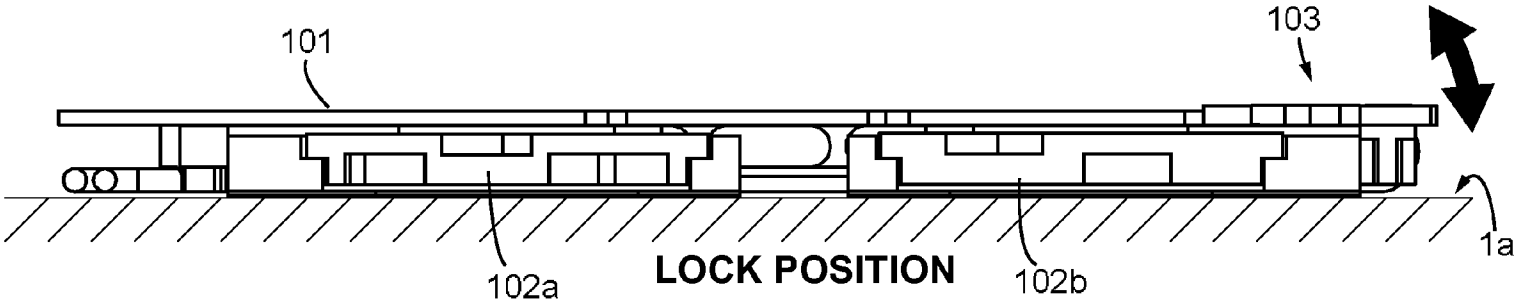

FIGS. 12A and 12B are section views through the long axis of a baseplate mechanism, and show the operation of the latching toe pedal system 103 in ride mode. Pedal plate 104 opens and closes as shown (arrows), forcing the detent member 106 to contactingly engage the exposed toewise end of the mounting puck interface (102*a*, 102*b*), where it prevents disengagement of the baseplate from the mounting pucks. The mounting pucks are firmly affixed to the top surface 1*a* of a gliding board. The baseplate includes a bottom channel with inwardly flanged on either side; the flanges conjoiningly engage mating flanges on the mounting pucks when slidably inserted into the channel as illustrated in the preceding figure. The detent member also locks pintles 111 when depressed by the toe of a rider, as serves to lock the baseplate onto a ski touring mode interface in ski touring mode, as shown in FIG. 10B. Thus the binding system is bifunctional, using a single mechanism, the toe latch pedal mechanism 103, to switch from ride mode to ski mode.

Thus in another aspect, the invention is a method for changing a boot binding from ski mode to ride mode with a single binding mechanism. The switch can be accomplished in less than 20 seconds, and comprises: a) lifting a toe latch pedal of a boot binding baseplate from a LOCK POSITION flush with the baseplate (when lockingly engaged to a ski touring mode interface) to a raised RELEASE POSITION thereby disengaging the ski touring mode interface; b) moving the baseplate to a ride mode interface and inserting the baseplate onto a plurality of anchor pins thereon; and, c) depressing the toe latch pedal from the RELEASE POSITION to the LOCK POSITION, thereby lockingly engaging the baseplate onto the ride mode interface. Similarly, the transition from ride mode interface to ski touring mode interface is performed by reversing these steps. FIGS. 8A-8B and 12A-12B illustrate the two interfaces. The baseplate combination 110 is enabled to be repositioned interchangeably between either the ride mode interface (configuration 130) or the ski touring mode interface (configuration 131) and secured by using a single common toe latch pedal mechanism. Baseplate assemblies may be configured for right and left boots, or may be universal assemblies for either foot.

Figure 12C:
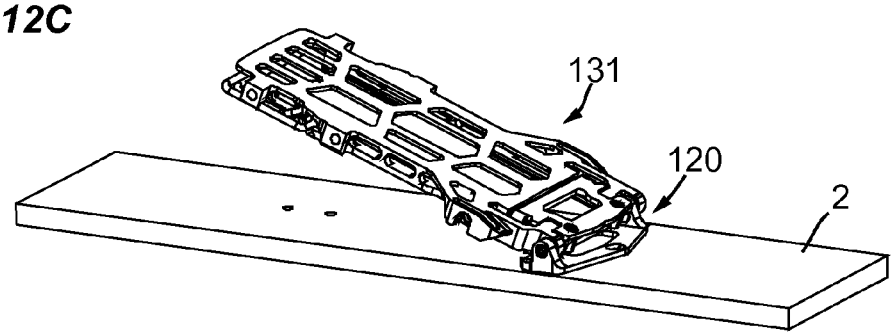
FIGS. 12C, 12D and 12E are elevation views showing the operation of the toe pivot and climbing bar assembly in ski touring mode.
Figure 12D:
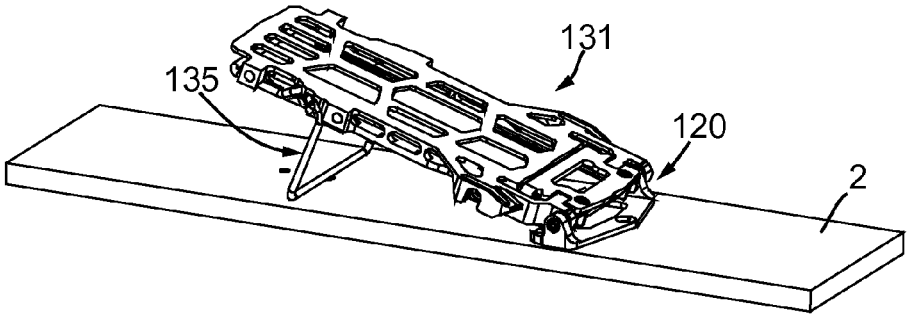
Figure 12E:
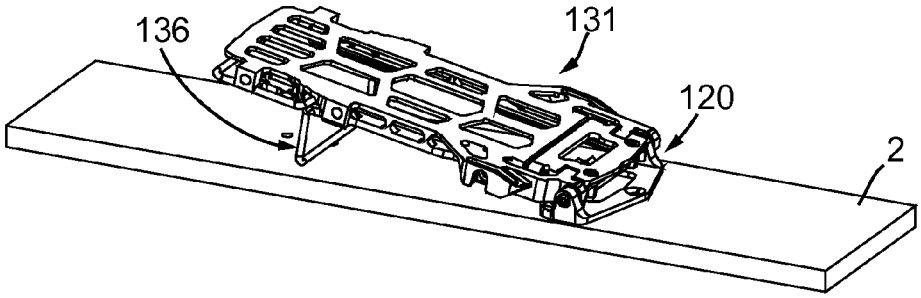

FIGS. 12C, 12D and 12E are perspective views figuratively showing the operation of the toe pivot and climbing bar assembly in touring mode on the top surface of a ski member 2 of a splitboard. A boot binding baseplate assembly is engaged on ski touring mode interface bracket and toe pivot axis 120 in ski touring configuration 131. In FIG. 12C the baseplate combination is shown to pivot. In FIGS. 12D and 12E, climbing bars (135, 136) are deployed to aid a rider in ascending a slope.

Figure 13:
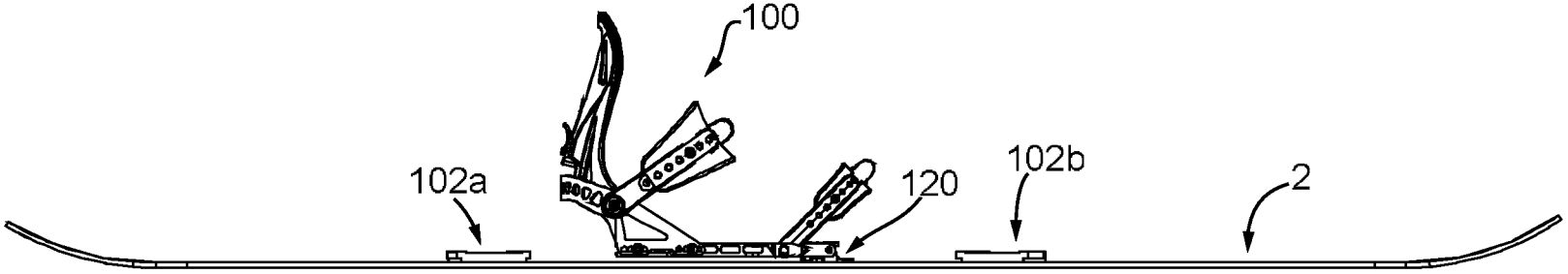
FIG. 13 is a rendering of a combination of a splitboard ski half in side view and a boot binding assembly of the invention mounted on the ski.

FIG. 13 is a rendering of a combination of a splitboard ski member 2 in side view and a boot binding 100 having a bifunctional interface engagement mechanism with latching toe pedal of the invention. In this view the boot binding is reversibly locked onto a ski touring mode interface 120 and may be interchangeably repositioned onto ride mode interface members 102*a* and 102*b* when ski members (2*a*, 2*b*) are combined (joined at 1*b*) as a splitboard 1, as shown in FIG. 14A.

Figure 14A:
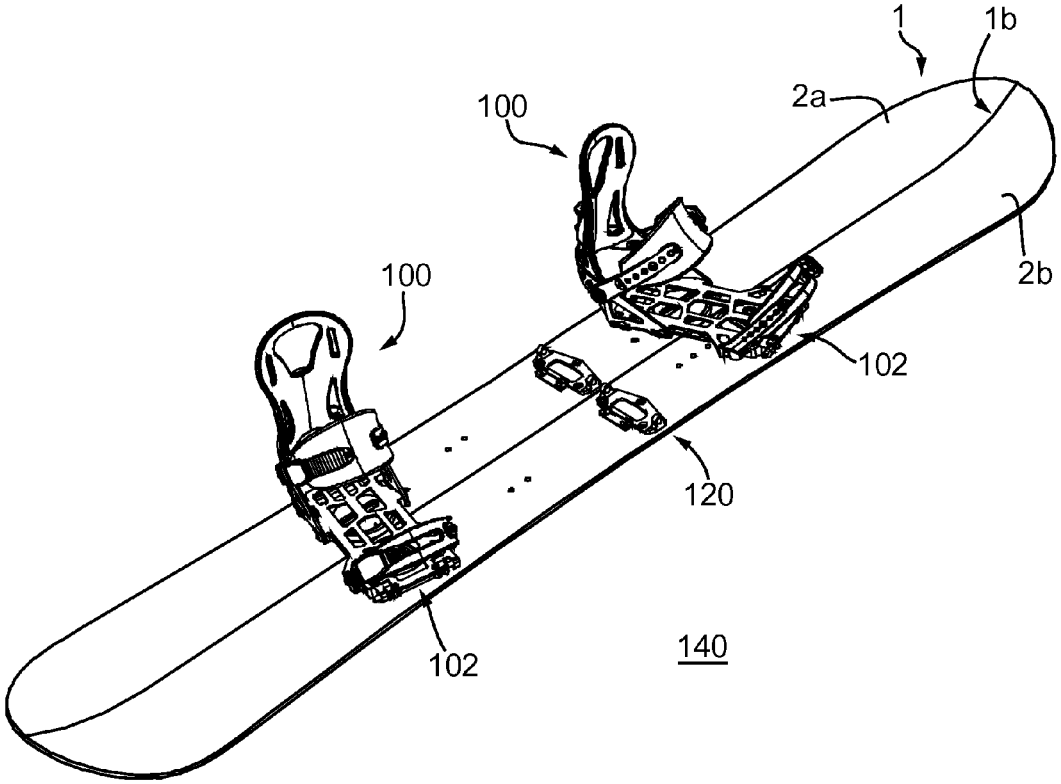
FIG. 14A is a perspective rendering of a combination of a splitboard in ride mode and two boot binding assemblies of the invention docked on the board.

FIG. 14A is a perspective rendering of a combination 140 of a splitboard 1 in ride mode configuration, having two boot bindings 100 docked on the board using a novel bifunctional interface with latching toe pedal mechanism. Thus the inventive boot binding systems of the invention may also be combined with a splitboard and sold as combinations 140 therewith, adding economic value beyond the mere ratio of the component price. Also included here is a ski touring mode interface 120 and a ride mode interface 102 compatible with boot binding latching systems of the invention. The ski touring mode interface and ride mode interface may be sold as a kit or sold separately and are generally supplied with fasteners (not shown).

Figure 14B:
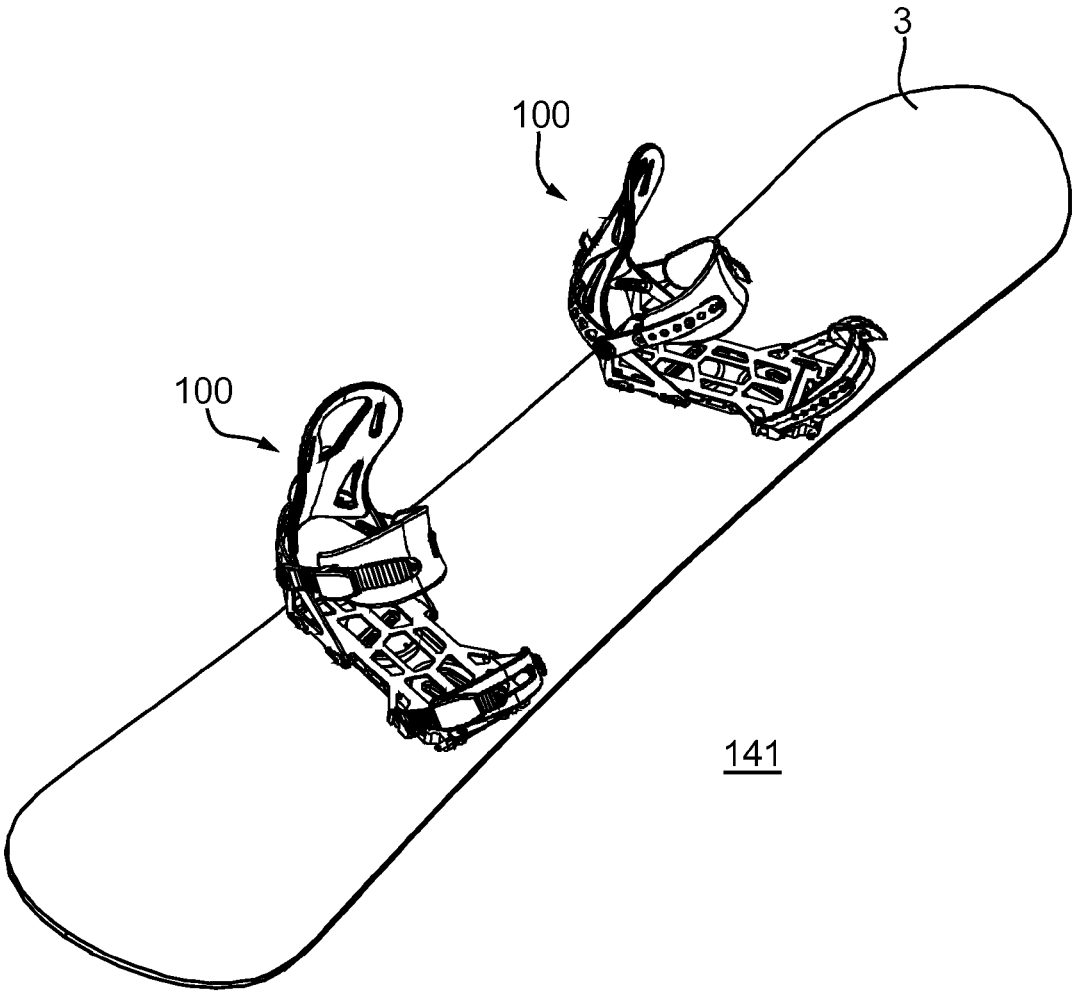
FIG. 14B is a view of a solid board in ride mode having boot binding assemblies of the invention docked on the board.

FIG. 14B is a view of a solid snow gliding board 3 in ride mode combination 141 having boot binding assemblies docked on the board. Riders having multiple boards may find an advantage in having a single ride mode interface that is compatible with both a "splitboard" and a "snowboard" (also termed a "solid board"). Surprisingly, the boot binding system of the invention remains operative even after a snowboard such as figured here (3) is sawed lengthwise to convert it to a splitboard (compare FIG. 14A, 1, 1*b*); the loss to the saw kerf not impacting the functional capacity of the binding interface.

Figure 15:
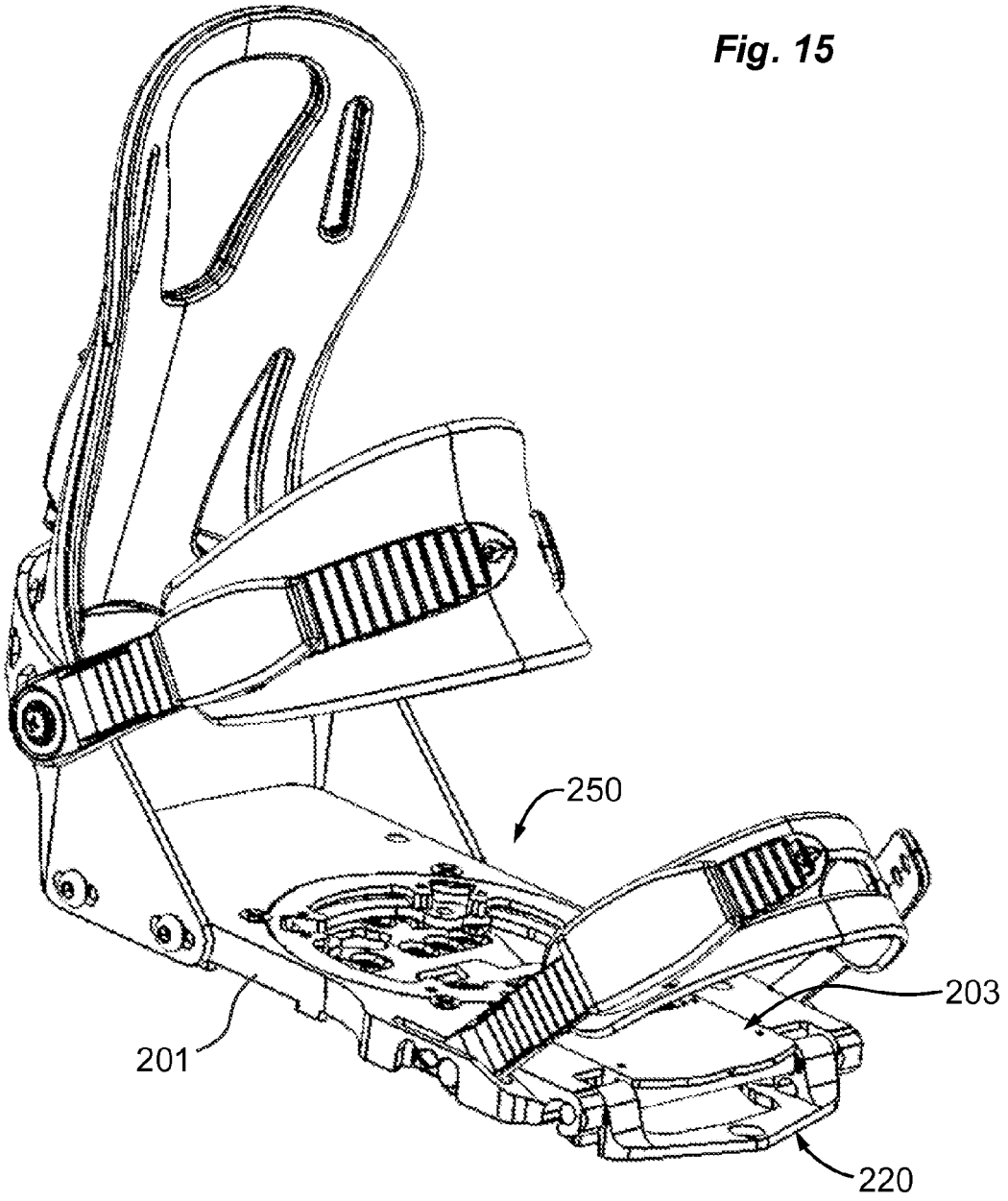
FIG. 15 is a perspective view of a second exemplary boot binding system of the invention.

An alternate embodiment of the invention is shown in FIG. 15. Shown is a perspective view of a second exemplary boot binding system of the invention with alternate latching toe pedal mechanism 203 in a ski touring configuration 200. The toe latch pedal mechanism is mounted to baseplate 201, and is shown to engage a toe pivot axle shaft of an alternate ski touring mode interface 220, as will be described in more detail below. Disposed centrally is an alternate ride mode interface engagement system 250 having a ring-like configuration described below.

FIG. 16 is an elevation view of the embodiment of FIG. 15 in which the ski touring mode interface (220, FIGS. 17A, 17B) is removed. Shown is baseplate 201 and alternate toe latch pedal mechanism 203. Strap and heel cup members for securing the rider's boot are attached to the outside walls of the baseplate 201. Conventional boot binding features include toe strap 211, ankle strap 212, heelcup 213, and a forward lean adjustor 215. A highback 214 is typically attached to the heel cup. Toe pedal plate 204 is shown in an upright, disengaged position relative to the baseplate, and supports a detent assembly 206. The toe pivot mounting assembly includes a pair of anterior nose members 253 (also termed "stationary jaws") with inverted nose hooks 205 readily seen in this view.

The latching mechanism again has dual functions. In a first configuration, the toe latch pedal feature secures the baseplate onto a ski touring mode interface, also termed a toe pivot cradle, forming what is termed a ski touring configuration. The embodiments of FIGS. 1 and 15 are related by a duality of function of the toe latch pedal, although the embodiments differ in structural features.

FIGS. 17A and 17B are front elevation and side views of a ski touring mode interface 220 having a toe pivot axle shaft 221 and a toe bracket with a pair of toe pivot ears 222. The toe pivot axle shaft may be secured in place with circlips, for example, and optionally may include sleeve bushings. The mediolateral extensions of the toe pivot axle shaft shaft engage the nose hook members 205 of the baseplate in ski mode. In another embodiment the toe bracket also includes a center post and the bearing surfaces of the shaft are distributed on each side of the center post.

Figure 18A:
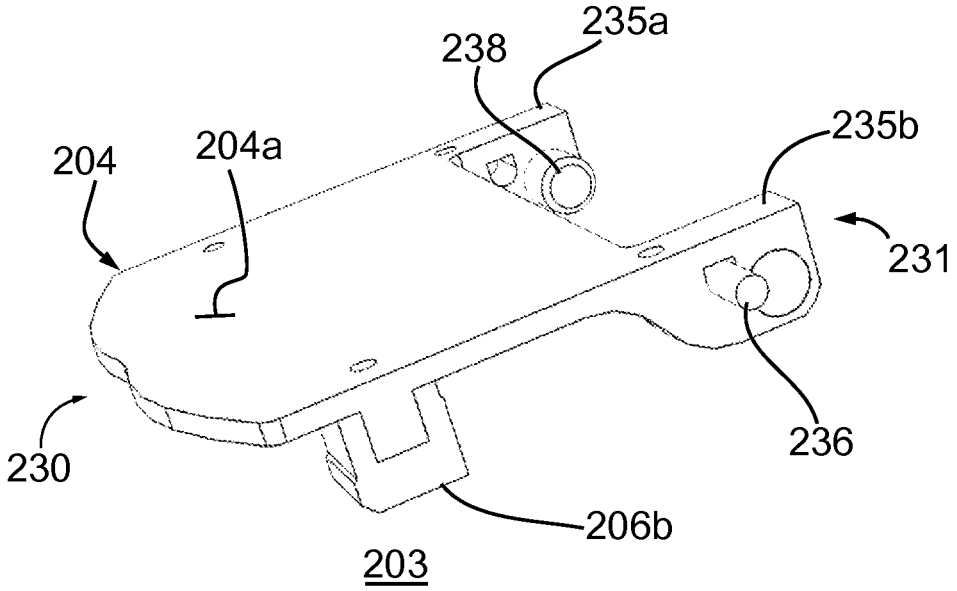
FIGS. 18A and 18B are perspective views of a toe pedal for use with the boot binding system of FIG. 15.
Figure 18B:
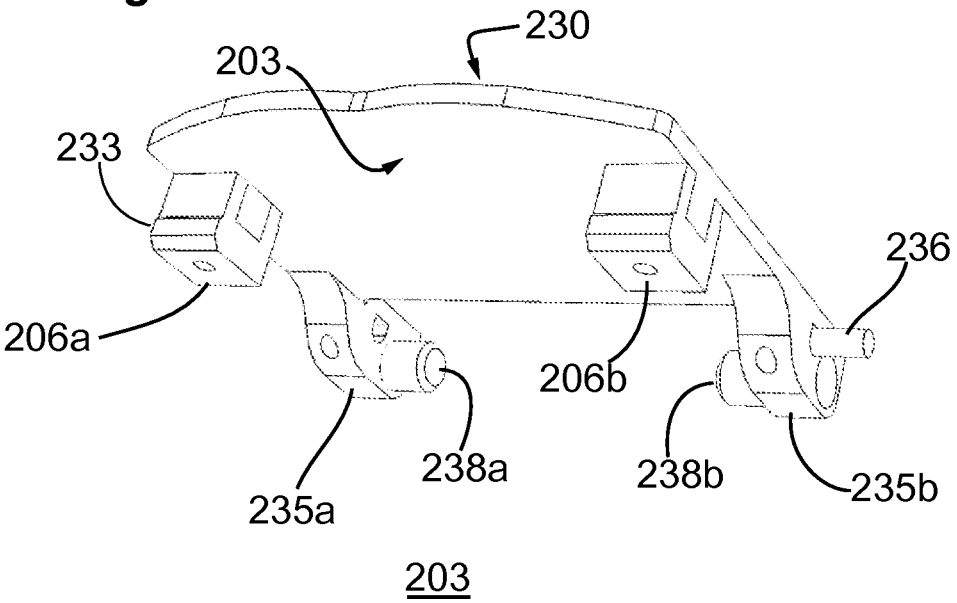

FIGS. 18A and 18B are perspective views providing more detail of the toe latch pedal assembly 203 of this embodiment. The toe pedal plate 204 has a toe or pawl end 230, a heelward end 231, and a toe pedal plate top face 204*a*. Mounted under the toe end are a pair of detent members or blocks (206*a*, 206*b*), contralaterally disposed, one on each side of the pedal plate. The forward face of each detent member includes a tooth 233 so that when pressed down, the detent members will "snap-lock" onto the toe pivot shaft 221 of the ski touring mode interface 220, retaining the shaft in the grip of nose hooks 205. The baseplate 201 is free to pivot on the toe pivot shaft 221 when affixed in the nose hooks, and resists lateral and torsional displacement when the rider is in free heel skiing or touring mode.

The heelward end 231 of the toe pedal is modified with two posterioinferior pivot ears 235*a*, 235*b*. Pivot pins 236 permit the pedal to rotate in a mounting box slot or cutout (209, FIG. 21) in the baseplate. Rotation is from a horizontal flush position corresponding to a "LOCK POSITION" to a generally vertical position corresponding to a "RELEASE POSITION" (FIGS. 19 and 20). Cam drive pins 238*a*, 238*b* are mounted eccentrically on the ears, and convert the rotational motion of the toe latch pedal into a linear motion of the ride mode dogging bolt (249, FIGS. 20, 21, 23-26), as will be shown below.

Figure 19A:
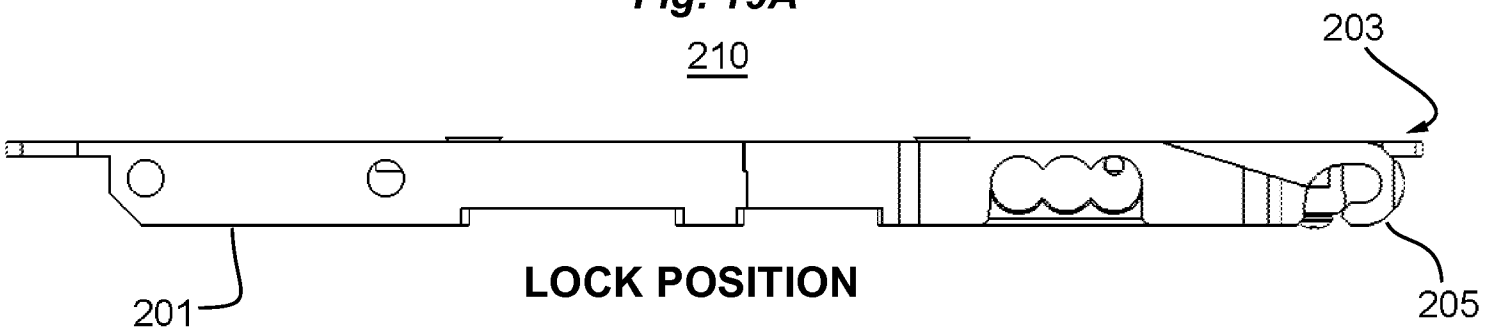
FIGS. 19A and 19B are isometric side views of the baseplate and latching assembly in the engaged (FIG. 19A) and disengaged (FIG. 19B) position.
Figure 19B:
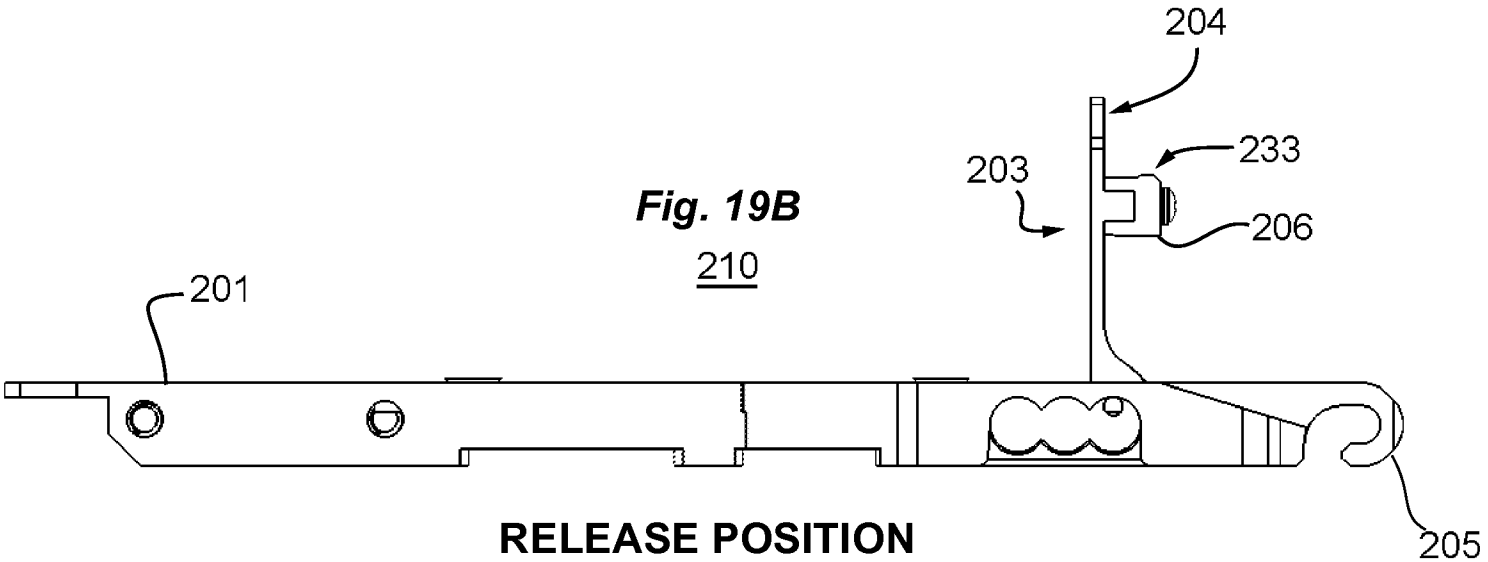

FIGS. 19A and 19B are isometric side views of the alternate baseplate-latching toe pedal combination 210 in the engaged (LOCK POSITION) and disengaged (RELEASE POSITION) positions. Also shown is detent member or pawl 206, which is affixed to the toe latch pedal plate 204. The toe latch pedal mechanism 203 rotates from a first, horizontal configuration to a second, vertical configuration relative to the baseplate 201. The tooth 233 on the detent member is for locking the toe pivot shaft in the hooked grasp of the front stationary jaw nose hooks 205. Thus in the vertical position (of the toe pedal) the toe pawl or detent is disengaged and the toe pivot axle shaft may be detached from the stationary nose hooks, and in the horizontal position the toe detent member or pawl is engaged to lock the baseplate to the toe pivot axle shaft, as is useful in engaging the ski touring mode interface. The rider's boot toe secures the toe pedal plate top face 204*a* in the lock position.

Figure 20A:
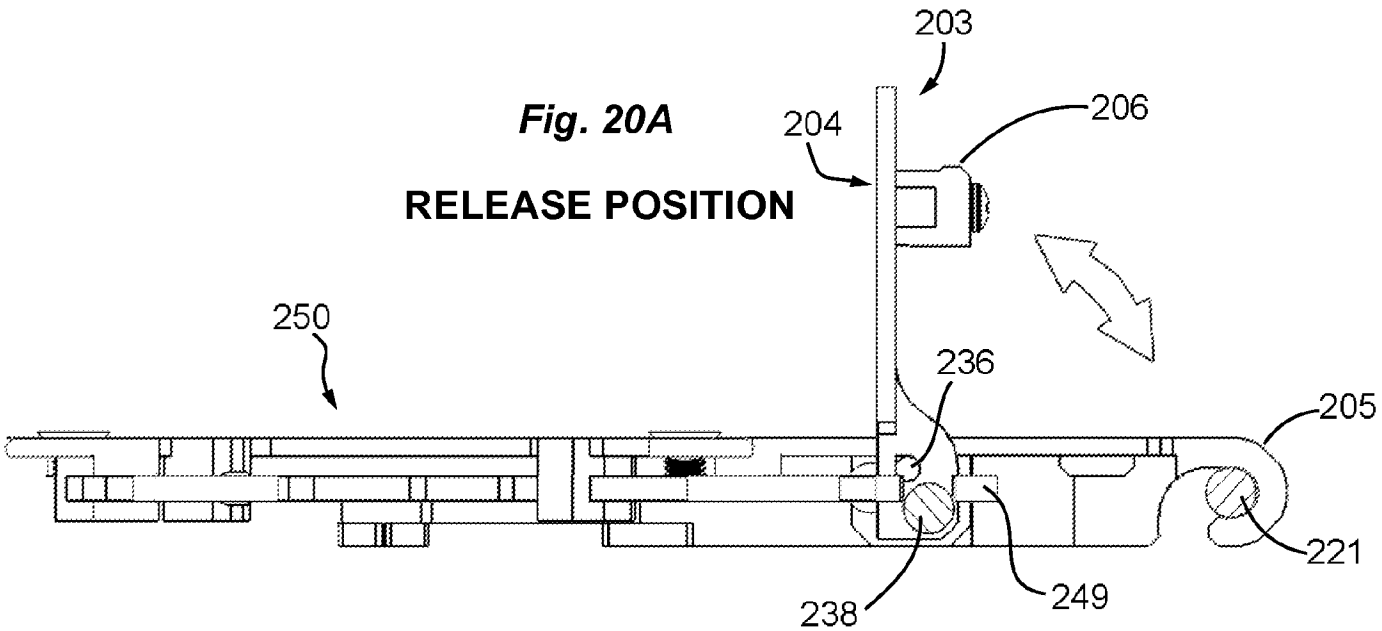
FIGS. 20A and 20B demonstrate the action of the toe pedal latching mechanism in engaging and locking the toe end of the baseplate around the toe pivot shaft in cross-section. A stationary jaw member with nose hooks and a detent member mounted on the toe pedal releasably engage the toe pivot shaft.
Figure 20B:
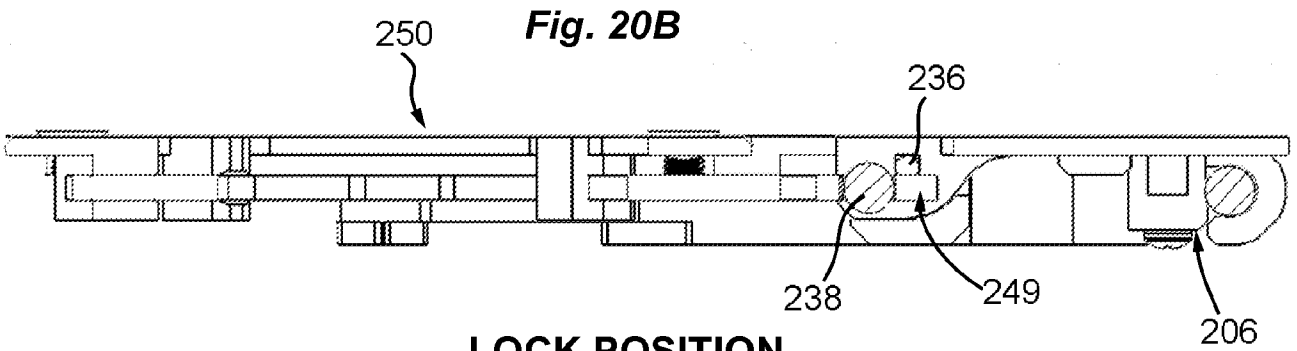

More detail of the ride mode interface engagement mechanism 250 is shown in FIGS. 20A and 20B. In the vertical position (RELEASE POSITION), the excentric cam drive pin 238 acts on a ride mode dogging bolt (249, FIGS. 20, 21, 23-26) to draw it toeward; and when the toe latch pedal is pressed flat (LOCK POSITION), the cam action drives the dogging bolt heelward in a horizontal motion. The double arrow indicates that the toe latch pedal rotates between the LOCK POSITION shown in FIG. 20B and the RELEASE POSITION shown in FIG. 20A. Details of the ride mode interface are described below.

FIGS. 20A and 20B also demonstrate the action of the toe pedal assembly 203 in engaging and locking (detent member, 206) the jaw formed by the nose hooks 205. Nose hooks 205, disposed contralaterally on the baseplate, reversibly engage toe pivot axle shaft 221 of the ski touring mode interface. The nose hooks 205 and detent members 206 releasably hold the baseplate on toe pivot axle shaft 221.

Figure 21:
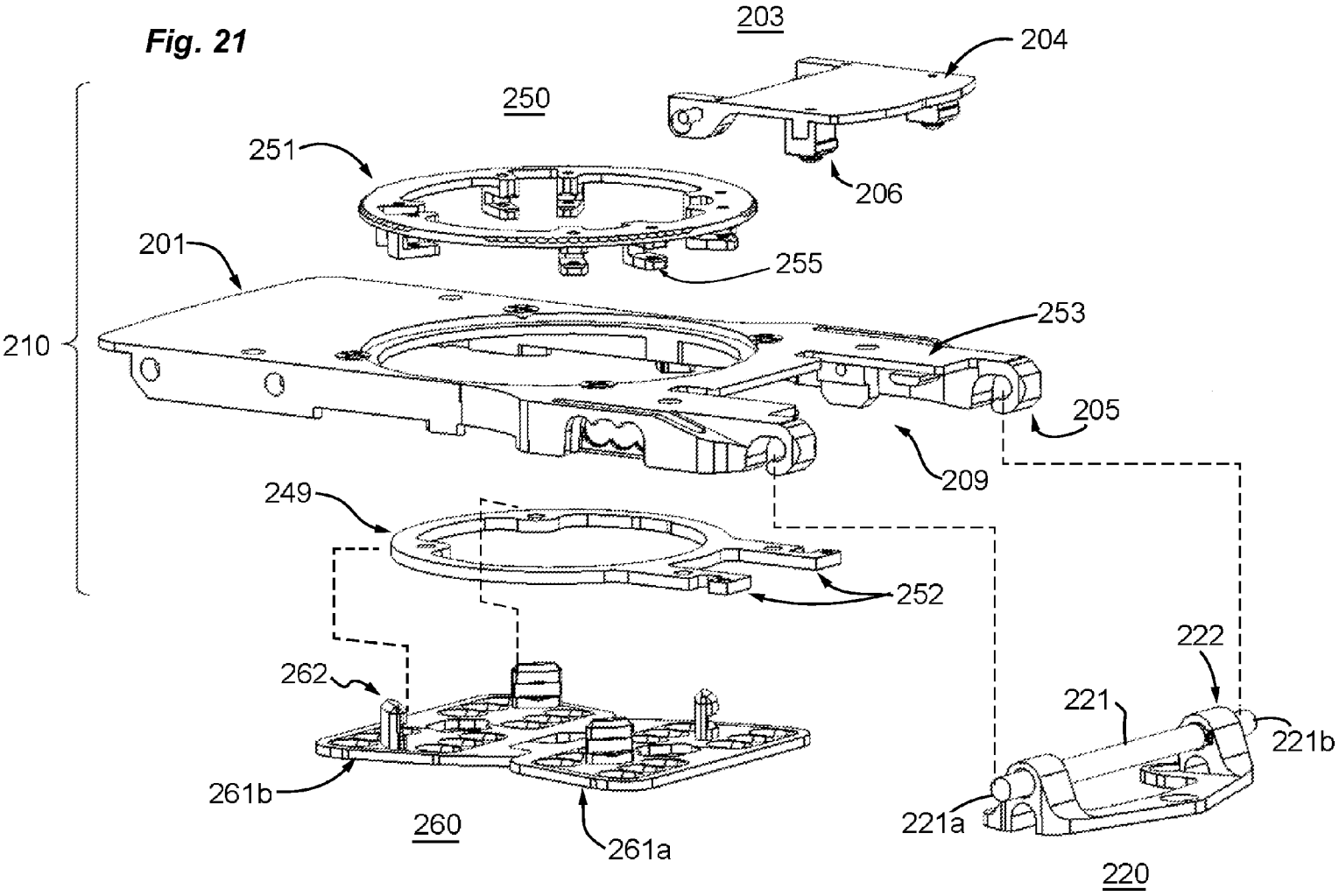
FIG. 21 is an exploded view of the latching mechanism of FIG. 15.

FIG. 21 is an exploded view of alternate baseplate-latching toe pedal combination 210 for engaging a ski touring mode interface 220 or a ride mode interface 260. Attaching straps and boot supports are not shown for simplicity. Latching toe pedal assembly 203 is shown at the top of a stack of parts, which includes, as drawn, in descending order a) an alignment hub ring 250, b) baseplate 201, and c) ride mode dogging bolt 249, shown here as a ring with anterior yoke members 252. The baseplate includes two contralateral anterior nose members 253 separated by a mounting box slot 209 for receiving the toe pedal plate 204. The baseplate interface assembly is enabled to interface interchangeably with either the ride mode interface 260 or the ski touring mode interface 220. When engaged on the ride mode interface, the boot binding system is termed to be in the ride mode configuration. When engaged on the ski touring mode interface, the boot binding system is termed to be in the ski touring configuration.

Also shown are two mating interface plates (261*a*, 261*b*) of a ride mode interface 260, each with anchor pins 262, and a ski touring mode interface 220 with toe pivot shaft 221 and toe pivot bracket 222. The toe pivot axle shaft extends medially and laterally (221*a*, 221*b*) past the toe pivot ears. Dotted lines indicate how the latching mechanism engages the separate interfaces. Both interfaces attach to the face of a splitboard; generally only the ride mode is used with a snowboard.

The underside carriage formed by brackets 255 on the alignment hub 251 capture the dogging bolt 249 and form a track to guide its horizontal sliding motion as urged by the drive cam pins of the toe latch pedal mechanism 203. As shown with a dashed line, yoke members 252 on the dogging bolt are slotted to couple the drive cam pin motion with the motion of the dogging ring in the carriage brackets. FIGS. 20 and 22B show the drive cam pin 238 engaging the dogging bolt 249.

Anterior nose members 253 formed as hooks 205 mediolaterally are configured to engage the mediolateral extensions of the toe pivot axle shaft (221*a*, 221*b*), as shown with a dashed line. Thus the latching toe pedal mechanism has dual functions, serving to lock the baseplate (with rider's boot) to the ski touring mode interface 220 as shown, but also functions to engage ride mode interface 260 (dashed lines).

Figure 22A:
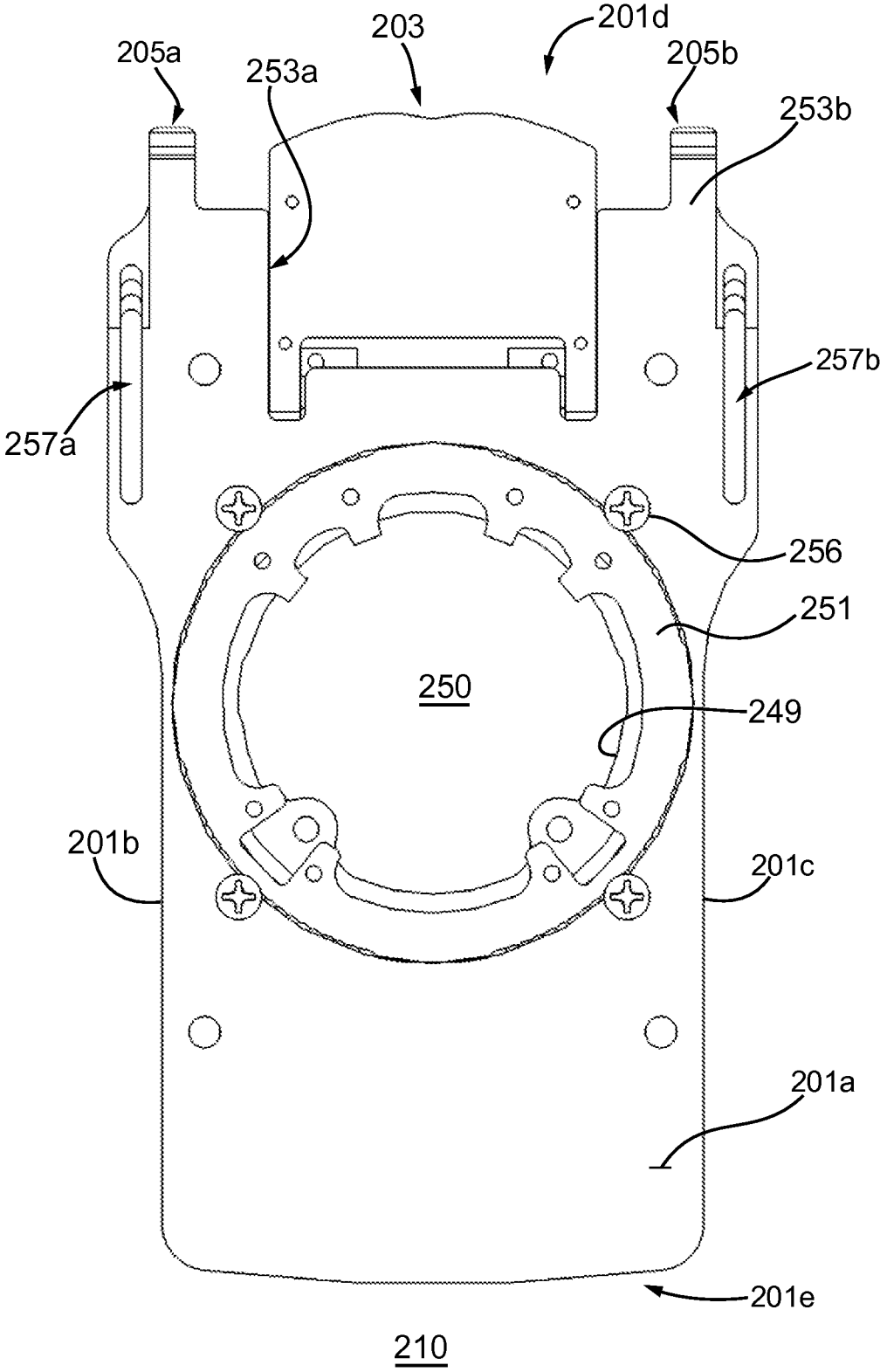
FIG. 22A is a top plan view of the baseplate with the toe latch pedal assembly.
Figure 22B:
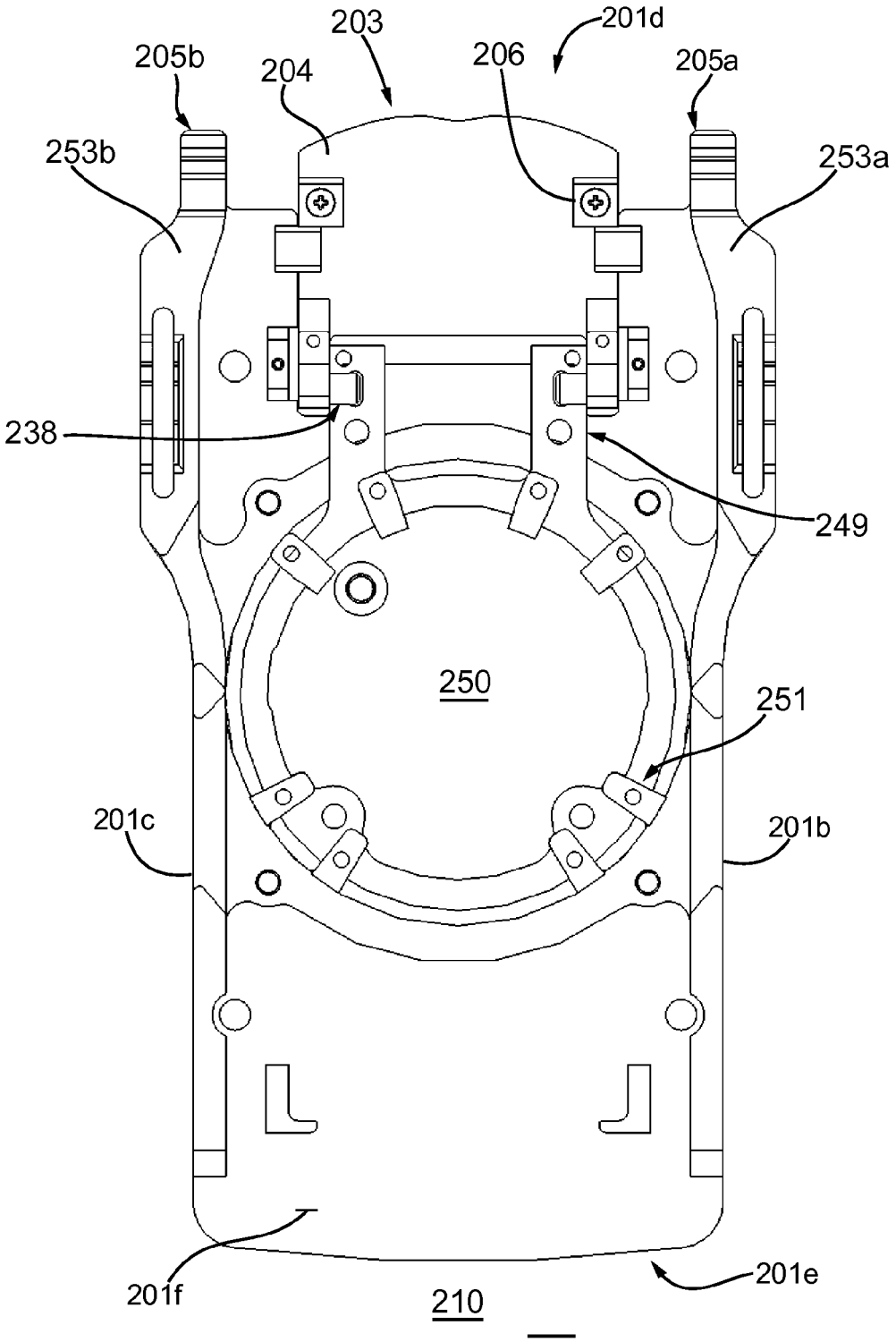
FIG. 22B is an underside view of the baseplate with toe latch pedal assembly.

FIG. 22A is a top plan view of the baseplate-latching toe pedal combination 210. Marked are the baseplate top surface 201*a*, the medial aspect 201*b*, the lateral aspect 201*c*, the anterior "toe" aspect 201*d*, the posterior "heel" aspect 201*e*, a medial anterior nose member 253*a*, a lateral anterior nose member 253*b*, and nose hooks 205*a*, 205*b*. FIG. 22A also shows the toe latch pedal mechanism 203 seated in the toe latch pedal mounting box slot defined between nose members 253*a* and 253*b* (as shown in FIG. 21, 209). The medial and lateral anterior nose members define the toe latch pedal mounting box slot therebetween.

The baseplate 201 can be seen to taper from a widest width proximate to the toe aspect or ball of the foot to a narrowest width proximate to the heel. The ring-type ride mode interface engagement mechanism 250 includes center hub alignment ring 251 with four alignment adjustment screws 256 and permits the rider to select and lock down a preferred foot rotational angulation for descents in ride mode. The scalloped perimeter of the alignment ring permits multiple seating positions for the fastening elements 256, allowing the user to adjust the ring to a preferred foot position.

As shown, the binding plate has axial symmetry, and hence the lateral and medial aspects are indistinguishable, as for a boot binding which is interchangeable between a right foot and left foot. However, in other embodiments, the boot bindings of a pair are not interchangeable, and thus have a distinguishable lateral aspect and a medial aspect corresponding to the anatomy of the rider's foot. For example, the medial and lateral arms may be proportioned or structured differently for strapping to a left boot and a right boot. Shown are mediolateral slots (257*a*, 257*b*) for mounting a toe strap.

FIG. 22B is an underside view of the baseplate combination 210 with latch actuator assembly 203 and toe pivot plate 204 mounted in the toe latch pedal mounting box slot of the baseplate 201. Shown under the baseplate bottom surface 201*f*, are drive cam pins 238, alignment hub ring 251, and dogging bolt 249 in this view.

Figure 23A:
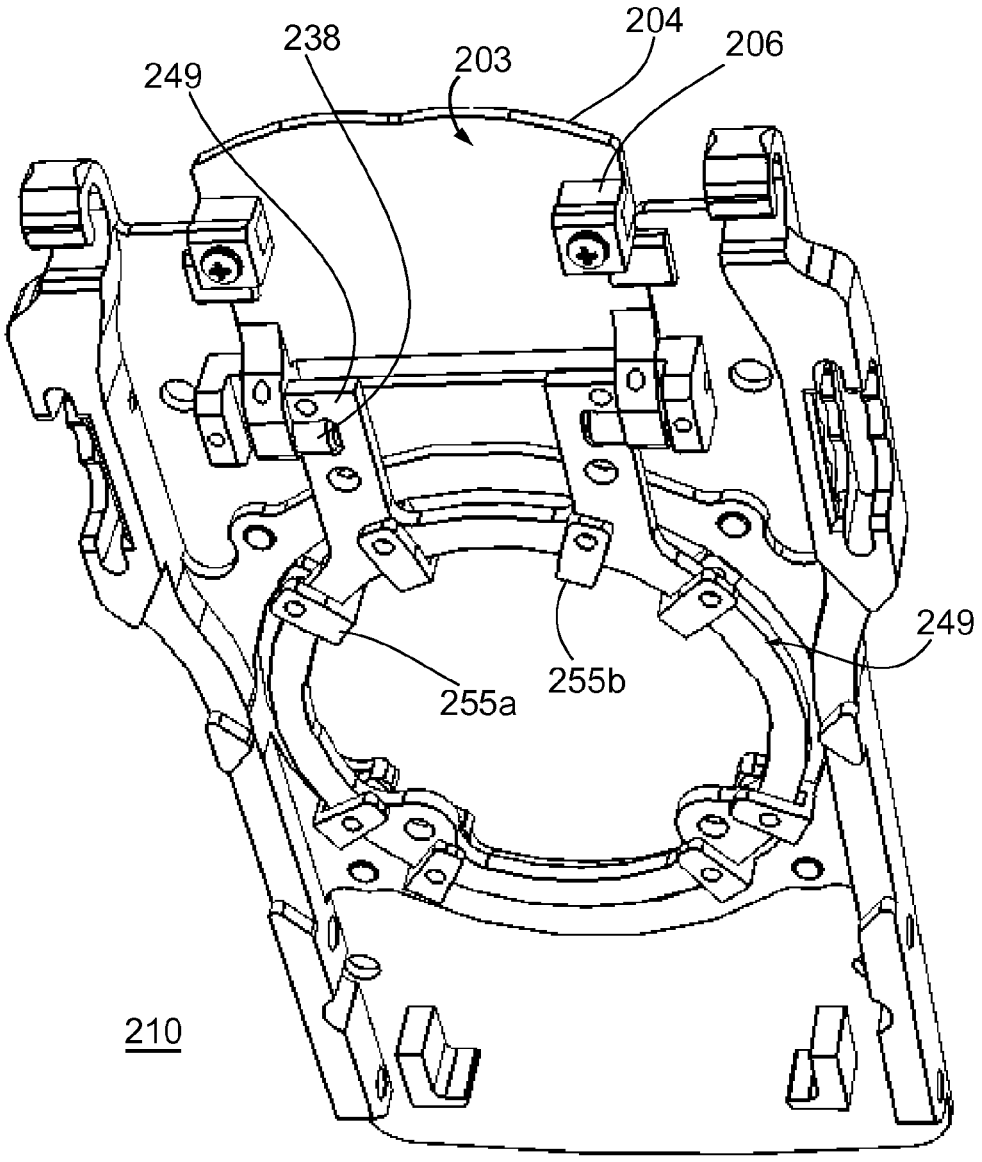
FIGS. 23A and 23B are perspective views of the underside of the baseplate, showing the cam action of the toe pedal on the ride mode dogging bolt as it toggles between a first position in which the dogging bolt is driven heelward and a second position in which the dogging bolt is drawn toeward.
Figure 23B:
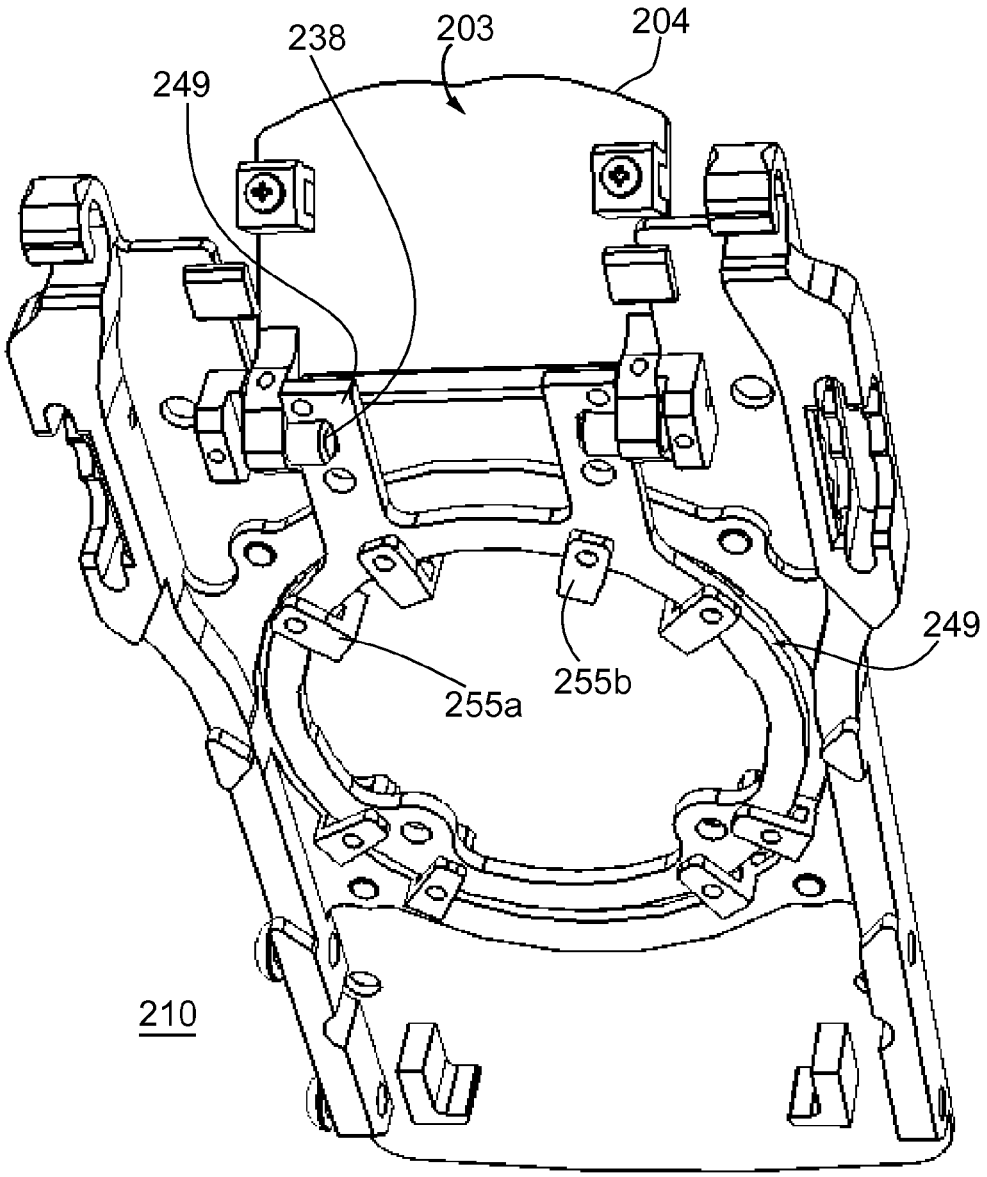

FIGS. 23A and 23B are perspective views of the underside of the baseplate, showing the cam action of the toe pedal plate 204 on forward yoke projections of the ride mode dogging bolt 249 as it slides between a first "lock" position in which the dogging bolt is driven heelward and a second "release" position in which the dogging bolt is drawn toeward. Eight carriage brackets (255*a*, 255*b* et seq) machined on the underside of the alignment ring form a track to capture and guide the dogging bolt in its reciprocal linear motion. In FIG. 23A (LOCK POSITION) the toe pedal plate is depressed and the dogging bolt is advanced heelward; in FIG. 23B (RELEASE POSITION) the toe pedal plate or lever is partially raised and the dogging bolt is advanced toeward, disengaging the baseplate from the ride mode interface. By comparing the two figures, the linear sliding action of the dogging bolt is demonstrated.

It can be seen that pivot action of the toe pedal plate or "latch actuator mechanism" simultaneously actuates both the ski touring mode interface latching effect and the ride mode interface latching effect, and the latching that is achieved is determined by which interface is engaged (comparing FIGS. 20-21 and FIGS. 25A-B).

Thus the toe latch pedal mechanism is bifunctional, and utilizes a detent or pawl 206 on the toe end and a cam driver 238 on the pivot end to achieve a synergy of function. In a first "release" position (FIGS. 19B, 20A), the latching system is not engaged and the baseplate can be detached, for example to be repositioned from one interface to another. In a second "lock" position (FIGS. 19A, 20B), the toe latch pedal mechanism 203 is flush with the baseplate and the detent member 206 locks the shaft of the toe pivot axle 221 inside the hooks of the nose member 205 in ski mode while preserving the toe pivot capability of the boot binding as for ski touring. Because of the weight of the rider's boot on the toe pedal plate top face, the binding cannot be inadvertently disengaged from the toe pivot axle in ski mode. Similarly, when using the ride mode interface, the ride mode dogging bolt 249 is pushed heelward by the cam action 238 and lockingly engages the slotted anchor pins 262. The choice of interfaces, not the latching mechanism, determines the choice of ride mode or ski mode, because a single latching mechanism is used for both. This is an advance in the art.

Thus in one aspect, the invention is a boot binding system which comprises a baseplate 201 with straps for strapping a rider's boot to the baseplate, and a toe pedal mechanism 202 mounted in the baseplate, the toe pedal having a detent 206 on a toe end and a cam drive pin 238 on a pivot end, the detent for locking the baseplate to a ski touring mode interface (220, shown is toe pivot axle 221 in FIG. 21) and the cam drive pin for driving a ride mode dogging ring heelward (as in FIGS. 20 and 23), thereby locking the baseplate to a ride mode interface 260 formed of two mating ride mode interface plates 261 in ride mode.

In another aspect, the invention is a method for interchanging a boot binding from ski mode to ride mode that can be accomplished in less than 20 seconds, which comprises: a) lifting a toe latch pedal mechanism of a boot binding baseplate from a LOCK POSITION flush with the baseplate (when lockingly engaged to a ski touring mode interface) to a raised RELEASE POSITION thereby disengaging the ski touring mode interface; b) moving the baseplate to a ride mode interface and inserting the baseplate onto a plurality of anchor pins thereon; and, c) depressing the toe latch pedal mechanism from the RELEASE POSITION to the LOCK POSITION, thereby lockingly engaging the baseplate onto the ride mode interface. Similarly, the transition from ride mode to ski mode is performed by reversing these steps.

Figure 24C:
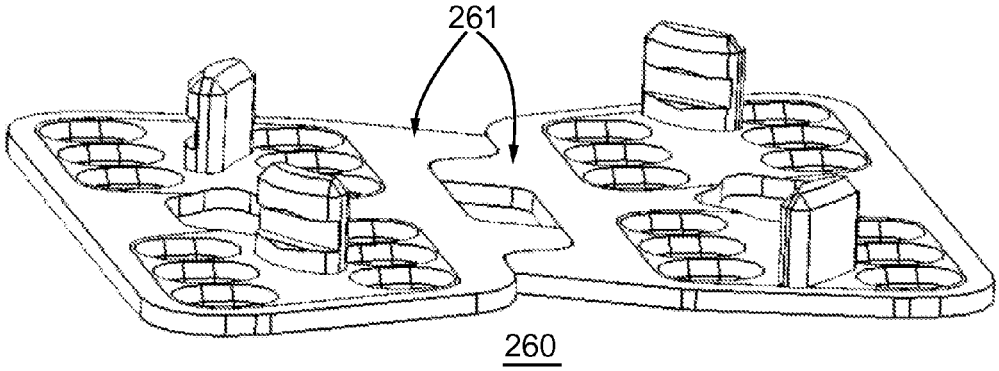
FIGS. 24A, 24B and 24C are plan, elevation, and perspective views of a first ride mode interface member of the boot binding system of FIG. 15.
Figure 24B:
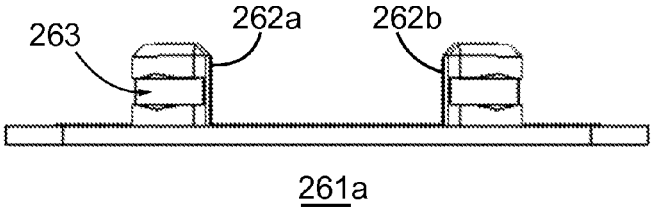
Figure 24A:
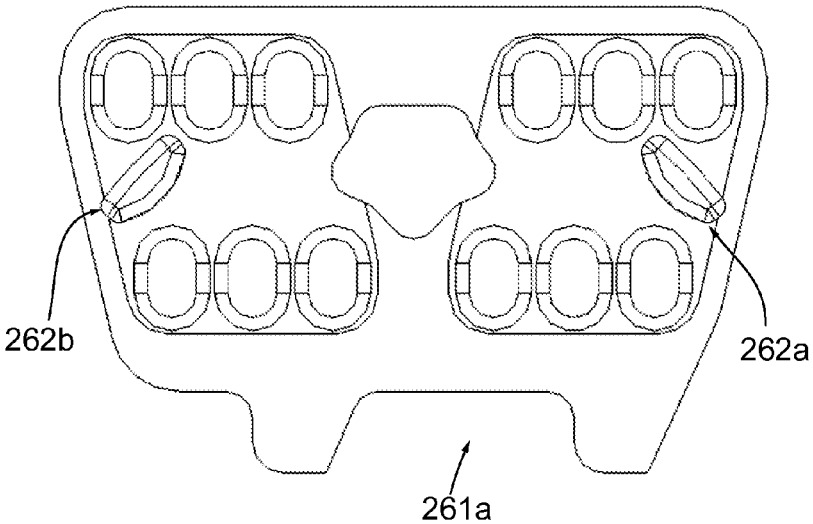

FIGS. 24A and 24B are plan and elevation views of a first interface plate 261*a* of the ride mode interface assembly

260. Anchor pins (262*a*, 262*b*) are elevated and are slotted 263 to engage the leading edge of the dogging bolt in the lock position (toe pedal plate down). Each interface plate has two anchor pins; therefore a total of four anchor pins are used per boot in the ride mode interface. All the lateral slots on the anchor pins are oriented to engage the dogging bolt when it is advanced into its locking, heelward position.

During ride mode use, the boot binding system is seated onto the anchor pins with the toe latch pedal in the disengaged position. The toe latch pedal is then rotated down into the lock position and dogging bolt 249 slides into the lateral slots in the anchor pins. The slots are dimensioned to tightly engage the dogging bolt but may be cut with a small clearance so that the bolt action is smooth. This clearance may be decreased by putting a taper on the leading edges of the dogging bolt or by adding elastomeric bumpers between the corners of the baseplate and the superior surface of the board. Details of the anchor pins 262 and slots 263 shown here do not limit the invention; the pins may be reconfigured to include round pins, crescent shaped pins, square or rectangular pins, for example, while not limited thereto. The range of conformations that the anchor pin/dogging bolt combination may take is determined by the linear advance of the dogging bolt as its leading edge slides into contact with the anchor pin.

In FIG. 24C, the complete ride mode interface 260 is shown in perspective, consisting of two mated interface plates 261 with interdigitating teeth. These teeth extend across the seam between the two halves of the splitboard in ride mode and prevent slippage of the junction.

Figure 25A:
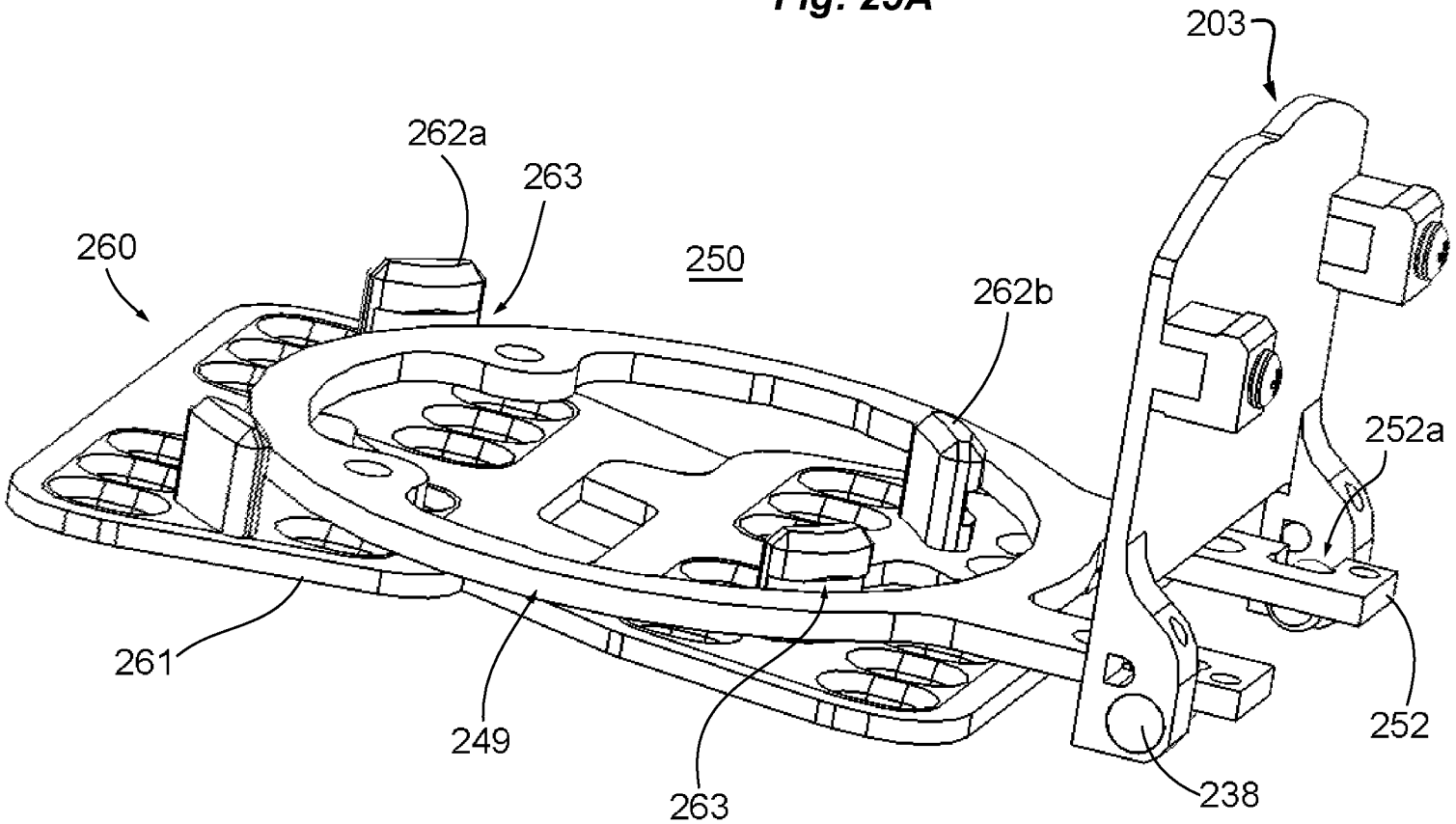
FIGS. 25A and 25B are views demonstrating the action of the toe pedal in engaging and locking the toe end of the baseplate around the toe pivot shaft. A stationary jaw member with nose hooks and a detent member mounted on the toe pedal releasably engage the toe pivot axle shaft.
Figure 25B:
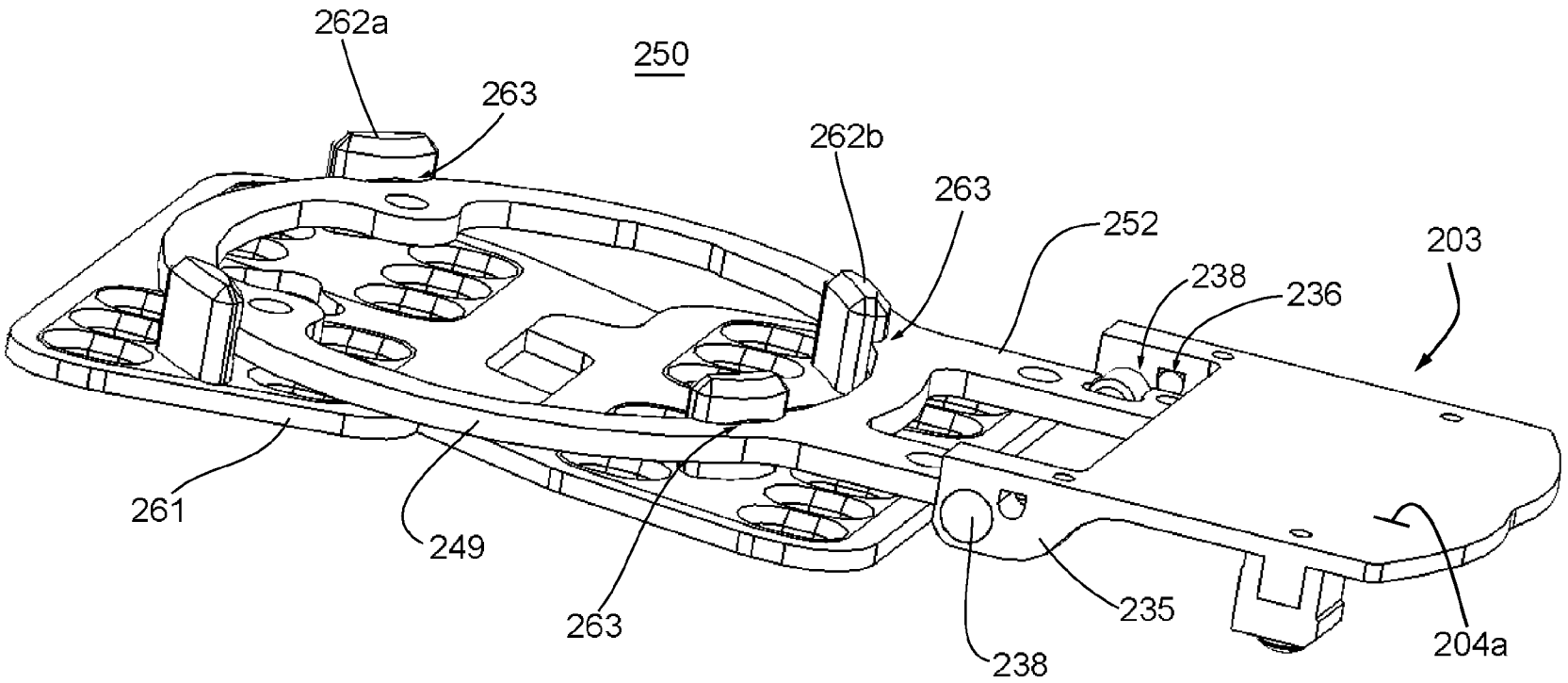

FIGS. 25A and 25B illustrates the drive cam 238 interaction with the ride mode dogging bolt 249, which in this embodiment is a ring with anterior yoke 252 members each having a lateral forward drive slot for engaging the cam wheels 238. The drive cam is mounted to rotate excentrically (as the toe pedal pivots on pins 236) in drive slot 252*a*. When the toe pedal is toggled from the upright to the horizontal position (relative to the baseplate) the dogging bolt engages mated retaining slots 263 in the four anchor pins (262*a*, 262*b*, et seq). Because of the weight of the rider's foot on the toe latch pedal 203, the ride mode interface engagement system 250 cannot be inadvertently disengaged from the ride mode interface plates 261. In FIG. 25B, the dogging bolt is engaged and locked in retaining slots 263 and the toe latch pedal mechanism is down (showing toe pedal plate top face 204*a*); in FIG. 25A, the dogging bolt is released and the toe pedal is upright.

While the embodiment as shown is provided with four anchor pins, other embodiments may contain different numbers of anchor pins. For example, in one instance, the heelward interface plate may have only a single anchor pin or may have three anchor pins. The anchor pins may be provided in different shapes. In some instances the anchor pins will be provided with holes or forks instead of slots for receiving the dogging bolt, which will have mating engaging surfaces.

Figure 26:
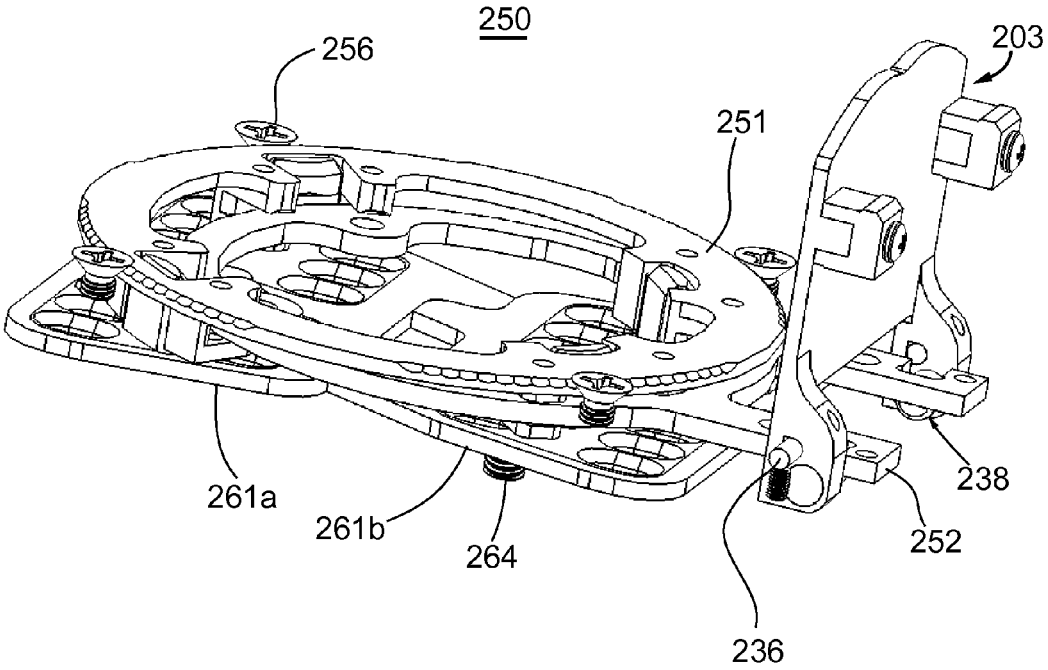
FIGS. 26, 27A and 27B illustrate a center hub alignment ring formed with circumferentially arrayed detents for fastenably (four screws) adjusting angular alignment of the baseplate on the stationary ride mode interface plates.
Figure 27A:
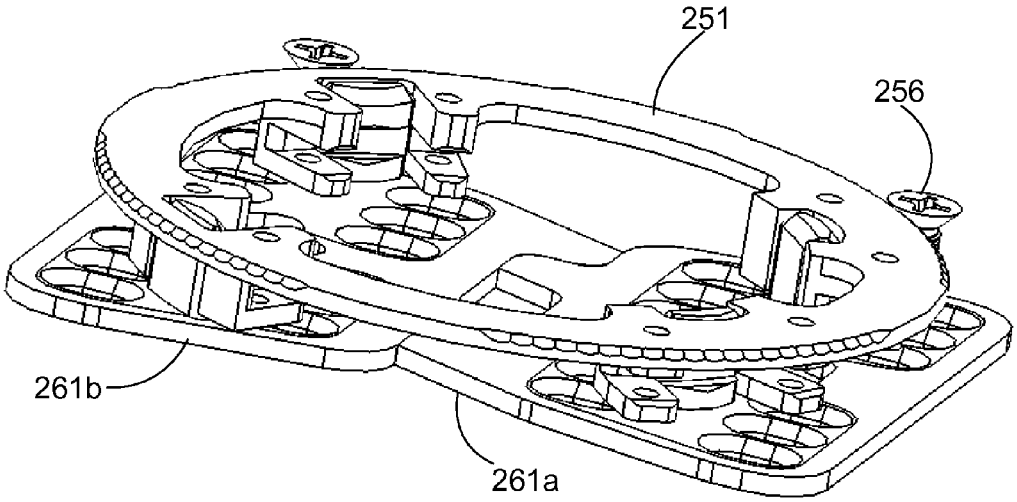
Figure 27B:
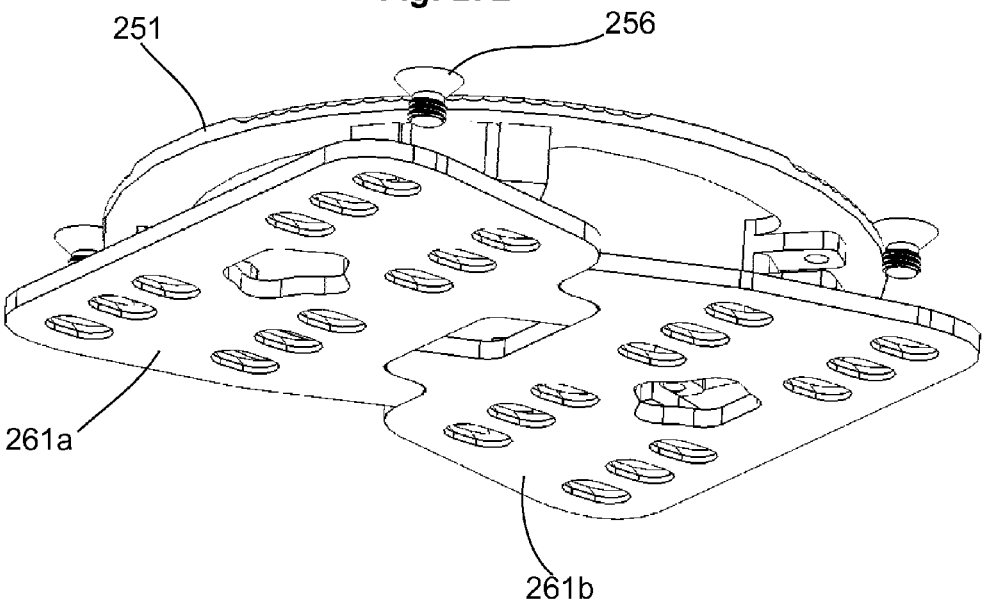

FIGS. 26, 27A and 27B illustrate the ring-type alternate ride mode interface 250 with center hub alignment ring 251 formed with circumferentially arrayed detents (scalloped dimples) for fastenably (four screws, 256) adjusting angular alignment of the baseplate on the stationary ride mode interface plates (261*a*, 261*b*). The four screws are threaded into the baseplate (as shown in FIG. 22A). Also shown is a threaded end of one of the bolts 264 for affixing the ride mode interface plates to the surface of a splitboard ski member 2 (FIG. 28) fitted to interface with this ring type of toe-operated pedal. Conventional tee nuts installed during manufacturing in the board laminate are used to affix the interface members. Anterior yoke ends (252) of the dogging bolt are shown with slots for engaging the cams 238 of the toe latch pedal pivot assembly.

Multiple mounting-hole patterns are provided to accommodate different manufacturer's templates and to allow riders to position the interface on the surface of a gliding board according to individual preferences.

A dual mounting hole pattern is offered that allows flexibility in using one binding and interface system on either a splitboard or a solidboard. And because many riders choose to make their own splitboards by cutting their solidboards in half, the mounting holes for solid board use are slotted so that the manufacturer's tee nuts can be lined up with the mounting holes without concern for the dimensional change resulting from the saw kerf when the board is cut down the middle due to LSC (less saw cut). This engineering optimizes the strength of the tee fasteners.

Riders having multiple boards need only mount the interface of the invention to all of the boards and can then use a single boot binding to switch from one board to another. Advantageously, once the interface plates have been installed, the time it takes to switch the bindings from one interface to another is less than 20 seconds.

Figure 28:
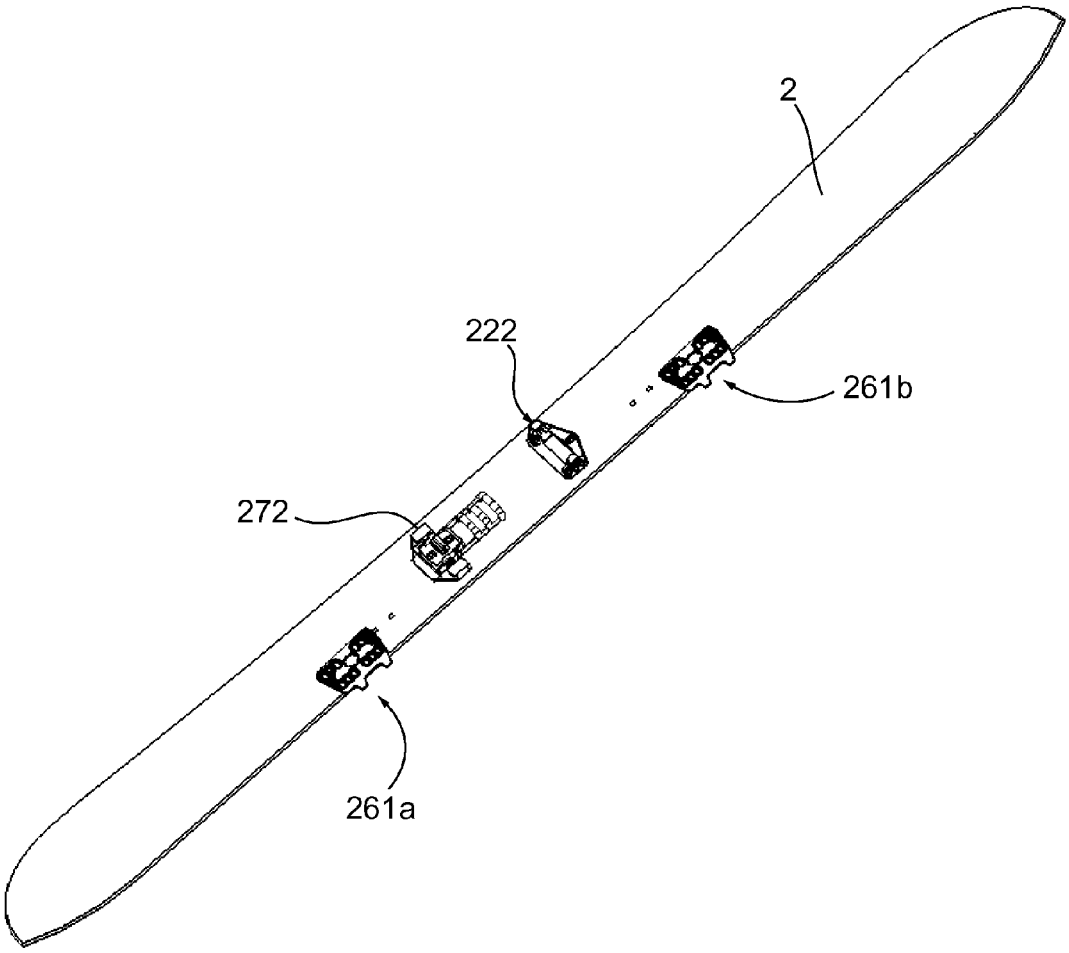
FIG. 28 illustrates interface members positioned on a single ski, showing a ski touring mode interface for use in ski touring configuration and two ride mode interface plates (one for each boot half) for use in ride mode configuration. The boot binding system includes fittings for a second ski member having mirror axis symmetry. "Splitboard" refers to two ski members which when joined together have the shape of a snowboard (see the gliding board member of FIG. 14).

FIG. 28 illustrates ski touring mode and ride mode interface members positioned on a single ski member 2 of a splitboard, showing a toe pivot bracket 222 for attaching the boot binding system in ski touring mode and two ride mode interface plates (261*a*, 261*b*, one pair for each of two ski members) for use in ride mode. Thus a total of four ride mode interface plates are required for securing two boots to a splitboard. The ride mode fittings for a second ski member have mirror axis symmetry for ease of manufacture. Also shown is a "climbing bar" assembly 272, which allows the rider to secure the toes of the baseplates to the ski touring mode interface and elevate his heels on the climbing bars during ascent in ski touring mode. Heel lock features may also be provided.

While there is provided herein a full and complete disclosure of more than one preferred embodiment of this invention, various other modifications, alternative constructions, changes and equivalents will readily occur to those skilled in the art and may be employed, as suitable, without departing from the true spirit, concepts and scope of the invention. Such changes might involve alternative materials, components, structural arrangements, sizes, shapes, forms, functions, operational features, or the like. The various embodiments described above can be combined to provide further embodiments. Therefore, the scope of the present invention should be determined not with reference to the above description but should, instead, be determined with reference to the appended claims, along with their full scope of equivalents, and any amendments made thereto. Accordingly, the claims are not limited by the disclosure.

REFERENCE NUMBERS OF THE DRAWINGS

1 splitboard having two halves
1*a* top face of a splitboard
1*b* split junction of a splitboard
2 ski half of a splitboard as a pair
2*a* first ski half of a splitboard
2*b* mating second ski half of splitboard
3 snowboard (or solid "snow gliding board")
100 first exemplary boot binding system
101 baseplate
101*a* long axis box channel

101*b* lateral rails with inside flanges
102 ride mode interface with mounting pucks
102*a*/102*b* first and second mounting pucks as pair
103 toe latch pedal mechanism
104 toe pedal plate
104*a* top face of toe pedal plate
105 hinge arms of toe pedal plate
106 detent member or block or pawl
107 offset pivot axle of hinge arm
107*a*/107*b* First and second toe pivot pins or "hinge pins" as pair
108 anterior nose members, contralaterally disposed
108*a*/108*b* anterior nose members as pair
109 mounting box slot defined between anterior nose members
110 baseplate-latching toe pedal combination
111 pintle pin
111*a*/111*b* first pintle pin and second pintle pin
120 ski touring mode interface/toe pivot mounting cradle with toe pivot ears
120*a* toe pivot ear
120*b* toe pivot hole
121 bushings of toe pivot ears
122 slot for hinge arms of toe pedal plate
130 boot binding baseplate system in ride mode configuration
131 boot binding baseplate assembly in ski touring configuration
135 first climbing bar
136 second climbing bar
140 combination of boot binding system and splitboard
141 combination of boot binding system and snowboard
200 second exemplary boot binding system
201 boot binding baseplate
201*a* top surface of baseplate assembly
201*b* medial aspect of baseplate assembly
201*c* lateral aspect of baseplate assembly
201*d* toe aspect of baseplate assembly
201*e* heel aspect of baseplate assembly
201*f* bottom surface of baseplate assembly
203 toe latch pedal mechanism
204 toe pedal plate
204*a* top face of toe pedal plate
205 nose hook of a pair
206 detent member
206*a*, 206*b* pair of detent members
209 mounting box slot defined between anterior nose members
210 alternate baseplate-latching toe pedal combination
211 toe strap
212 ankle strap
213 heelcup
214 highback
215 forward lean adjuster
220 alternate ski touring mode interface or "toe pivot cradle"
221 toe pivot axle shaft
221*a*, 221*b* mediolateral extensions of toe pivot axle shaft
222 toe bracket having toe pivot ears
230 toe end of toe latch pedal
231 heelward end of toe latch pedal
233 tooth
235*a*, 235*b* pivot ears of toe pedal as pair
236 pivot pins
238*a*, 238*b* Cam drive pins as pair
249 ride mode dogging bolt
250 alternate ride mode interface engagement system
251 center hub alignment ring
252 anterior yoke members of the dogging bolt
252*a* drive slot in anterior yoke member
253 anterior nose members, contralaterally disposed
253*a*, 253*b* anterior nose members of a pair
255 carriage brackets of center hub alignment ring
255*a*, 255*b* indicating plurality of carriage brackets of center hub alignment ring
256 alignment adjustment screws
257*a*, 257*b* mediolateral slots for mounting toe strap as pair
260 alternate ride mode interface
261*a*, 261*b* mating interface plates as pair
262 anchor pins
262*a*, 262*b* anchor pins as pair on interface plate
263 retaining slot in anchor pins for engaging dogging bolt
264 bolt for affixing ride mode interface plates to gliding board
272 climbing bar assembly

What is claimed is:

1. A boot binding and interface system, said system for securing a rider's boots to a splitboard, the splitboard having a pair of conjoinable ski members, the ski members when conjoined together defining a splitboard ride mode and when used separately defining a ski tour mode, said system comprising:

a) a pair of boot bindings;

b) a ski tour interface that comprises a pair of toe pivot brackets affixed one per ski member for mounting said boot bindings in ski tour mode, each said toe pivot bracket having a pair of toe pivot ears, each said toe pivot ear having two sides defined by an inside face and an outside face, each said toe pivot ear having a toe pivot hole coaxially defined therethrough, said toe pivot holes defining a toe pivot axis crosswise through said toe pivot ears;

wherein said boot bindings comprise each a boot binding baseplate having a heel end, a medial side, a lateral side, and a pair of nose members disposed at a toe end thereof, one nose member disposed medially and one nose member disposed laterally, each said nose members having two sides defined by an inside face and an outside face, and a pair of pintle pins disposed one per nose member, such that said pintle pins are disposed coaxially on said toe pivot axis proximate to said toe end; and, further wherein each said pintle pin is configured to insert by a single side motion into said toe pivot holes such that a) a first pintle pin inserts from an inside face of a first toe pivot ear and a second pintle pin inserts from an outside face of a second toe pivot ear;

or, b) a first pintle pin inserts from an outside face of said first toe pivot ear and a second pintle pin inserts from an inside face of said second toe pivot ear.

2. The boot binding and interface system of claim 1, said system said system comprising a means for lockedly engaging said boot binding baseplate to said ski tour interface on each said ski member.

3. The boot binding and interface system of claim 2, wherein said boot binding baseplate comprises a lock mechanism at said toe end, said lock mechanism comprising:

a) a mounting box slot defined between said nose members, said mounting box slot having an anterior open end and a posterior closed end; and, b) a toe latch pedal having a toe pedal plate joined by a hinge to said posterior end of said mounting box slot, said hinge having a pivot axis parallel to but offset from said toe pivot axis, wherein said toe pedal plate is pivotable on said hinge between a unengaged RELEASE POSITION and a engaged LOCK POSITION and includes a detent member disposed anterio-inferiorly thereon, wherein said detent member is configured to lockedly engage said boot binding baseplate to said toe pivot bracket when in said LOCK POSITION and to release said boot binding baseplate when in said RELEASE POSITION.

4. The boot binding and interface system of claim 3, wherein said toe latch pedal and detent member are configured to be pivotably wedged in said toe pivot bracket in said LOCK POSITION so as to lock said detent member endwise between a) an inside face of a first nose member and said inside face of said second toe pivot ear;

or, b) an inside face of a second nose member and said inside face of said first toe pivot ear.

5. The boot binding and interface system of claim 4, wherein said detent member in said LOCK POSITION is configured in be pivoted to said RELEASE POSITION by rotating said toe latch pedal from between said toe pivot ears and said nose members, and out of said mounting box slot.

6. The boot binding and interface system of claim 4, wherein disengagement of said pintle pins and detent member from said toe pivot ears in said LOCK POSITION is operatively prevented by the weight of a rider's boot on said toe pedal plate when said boot binding baseplate is lockedly engaged on said ski tour interface.

7. The boot binding and interface system of claim 6, said latch pedal plate of said locking mechanism is operative with an anterior pivot action, having a LOCK POSITION and a RELEASE POSITION, and said detent member mounted thereon is configured to engage and disengage said ski tour mode interface and said ride mode interface in alternation when switching between ski tour mode to splitboard ride mode.

8. The boot binding and interface system of claim 4, wherein said to latch pedal and detent member in said LOCK POSITION is configured in be pivoted to said RELEASE POSITION by rotation of said toe latch pedal out of said mounting box slot, thereby enabling said box channel to be slideably disengaged from said mounting block pair so as to release said boot binding from said ride mode interface.

9. The boot binding and interface system of claim 1, wherein said system comprises a splitboard ride mode interface, said ride mode interface having two pairs of mounting blocks affixed crosswise on said conjoinable ski members, one pair for each of a rider's boots in a generally crosswise stance, wherein said mounting blocks of each said pair are configured with co-aligned superiolateral outside flanges thereon.

10. The boot binding and interface system of claim 9, wherein said boot binding baseplate comprises an underside box channel and inferiolateral inside flanges configured to cooperatively grip and conjoin said superior outside flanges of each said pair of mounting blocks when slidingly engaged thereon.

11. The boot binding and interface system of claim 10, wherein said toe latch pedal and detent member of said boot binding baseplate is configured in said LOCK POSITION to be locked in said mounting box slot between said nose members so as to wedge against a toe-end face of said mounting blocks in ride mode.

12. The boot binding and interface system of claim 11, wherein said toe latch pedal and detent member are configured to capture said mounting block pair in said underside box channel of said boot binding baseplate when in said LOCK position.

13. The boot binding and interface system of claim 12, wherein disengagement of said detent member from said toe-end face of said mounting blocks is operatively prevented by the weight of a rider's boot on said toe pedal plate when said boot binding baseplate is lockedly engaged on said ride mode interface.

14. A method for lockingly engaging and disengaging a boot binding when ski touring, which comprises a) providing a ski tour interface having a toe pivot bracket for each foot, said toe pivot bracket having two toe pivot ears and a coaxial toe pivot hole in each of said toe pivot ears, and affixing said toe pivot bracket to a ski member;

b) providing a boot binding with boot binding baseplate for each foot, said boot binding baseplate having a heel end, a medial side, a lateral side, and a pair of nose members contralaterally disposed at a toe end thereof, one nose member disposed medially and one nose member disposed laterally, each said nose member comprising a pintle pin, wherein said two pintle pins define a toe pivot axis crosswise through said nose members proximate to said toe end; further wherein each said pintle pin is configured to insert into said toe pivot holes; and c) for each foot, inserting said pintle pins cooperatively into said coaxial toe pivot holes in said toe pivot bracket by:

i) directing a first pintle pin through an inside face of a first toe pivot ear and second pintle pin through an outside face of a second toe pivot ear by a single mediolateral sliding motion along said toe pivot axis; or, ii) directing said first pintle pin through an outside face of said first toe pivot ear and said second pintle pin through an inside face of said second toe pivot ear by a single latero-medial sliding motion along said toe pivot axis.

15. The method of claim 14, comprising:

a) providing said boot binding baseplate with a mounting box slot and a toe latch pedal at a toe end thereof, said toe latch pedal having a toe pedal plate joined by a hinge to said posterior end of said mounting box slot, said hinge having a pivot axis parallel to but offset from said toe pivot axis, wherein said toe pedal plate is pivotable on said hinge between a unengaged RELEASE POSITION and a engaged LOCK POSITION and includes a detent member disposed anterio-inferiorly thereon, wherein said detent member is configured to lock said pintle pins in said toe pivot holes when in said LOCK POSITION on said ski tour interface and to release said pintle pins when in said RELEASE POSITION in said ski tour interface; and, b) manipulating said toe latch pedal to said RELEASE POSITION and releasing said boot binding baseplate from said toe pivot bracket by a single sliding motion along said toe pivot axis.

16. The method of claim 15, comprising rotating said toe pedal plate so as to wedge said detent member in a LOCK POSITION, wherein said detent member is wedged between said toe pivot ears of a toe pivot bracket and said boot binding is free to pivot on said toe pivot axis.

17. The method of claim 16, comprising rotating said toe pedal plate to a RELEASE POSITION so as to release said detent member from between said toe pivot ears, and slidingly removing said two pintle pins from said toe pivot ears by a single sliding motion along said toe pivot axis.

18. The method of claim 16, comprising resting a boot on said toe pedal plate to retain a lock on said ski tour mode interface.

19. A method for lockingly engaging and disengaging a boot binding when splitboard riding, which comprises a) providing a splitboard ride mode interface having a pair of mounting blocks with superior outside flanges for each foot, and affixing said mounting blocks to a splitboard so that said superior outside flanges are aligned in a generally crosswise stance;

b) for each foot, providing a boot binding baseplate, said boot binding baseplate having a heel end, a medial side, a lateral side, an underside channel with inside inferior flanges, a mounting box slot, and a toe end with toe latch pedal having a toe pedal plate joined by a hinge to said posterior end of said mounting box slot, said hinge having a pivot axis parallel to but offset from said toe pivot axis, wherein said toe pedal plate is pivotable on said hinge between a unengaged RELEASE POSITION and a engaged LOCK POSITION and includes a detent member disposed anterio-inferiorly thereon, wherein said detent member is configured to lockedly capture said mounting blocks in said underside channel when in said LOCK POSITION and to release said boot binding baseplate when in said RELEASE POSITION;

c) sliding said underside channel onto said mounting blocks with said toe latch pedal in said RELEASE POSITION; and, d) then rotating said toe pedal plate to said LOCK POSITION so as to wedge said detent member against a toe-end face of said mounting block pair, thereby locking said boot binding baseplate on said pair of mounting blocks.

20. The method of claim 19, comprising resting a boot on said toe pedal plate to retain a lock on said splitboard ride mode interface.

21. The method of claim 19, comprising a) rotating said toe pedal plate to said RELEASE POSITION so as to release said detent member from said toe-end face of said mounting block pair; and, b) slidingly removing said boot binding baseplate from said pair of mounting blocks.

* * * * *